US007581471B2

(12) United States Patent
Chiu et al.

(10) Patent No.: US 7,581,471 B2
(45) **Date of Patent: *Sep. 1, 2009**

(54) OVER TORQUE PROOF SOCKET

(75) Inventors: Light Chiu, Taichung (TW); Kevin Tsai, Taichung (TW)

(73) Assignee: The Stanley Works, New Britain, CT (US)

( * ) Notice: Subject to any disclaimer, the term of this patent is extended or adjusted under 35 U.S.C. 154(b) by 71 days.

This patent is subject to a terminal disclaimer.

(21) Appl. No.: 11/406,367

(22) Filed: Apr. 19, 2006

(65) Prior Publication Data

US 2006/0236827 A1 Oct. 26, 2006

Related U.S. Application Data

(63) Continuation-in-part of application No. 11/111,970, filed on Apr. 22, 2005, now Pat. No. 7,475,619.

(51) Int. Cl.
*B25B 23/157* (2006.01)

(52) U.S. Cl. ..... 81/475; 81/473; 81/474; 81/476; 81/467; 81/58.3; 81/60

(58) Field of Classification Search ..... 81/473–476, 81/467, 121.1, 58.3, 60
See application file for complete search history.

(56) References Cited

U.S. PATENT DOCUMENTS

| | | | | |
|---|---|---|---|---|
| 1,442,123 | A | 1/1923 | Brown | |
| 1,954,620 | A | 4/1934 | Connell | |
| 2,471,614 | A | 5/1949 | Gilman | |
| 2,634,640 | A * | 4/1953 | Pedersen | 81/475 |
| 2,733,622 | A | 2/1956 | Evans | |
| 2,757,523 | A | 8/1956 | Schmid | |
| 2,819,635 | A * | 1/1958 | Better et al. | 464/35 |
| 2,977,832 | A | 4/1961 | Bless | |
| 3,024,682 | A | 3/1962 | Finkle | |
| 3,068,667 | A * | 12/1962 | Ernst | 464/23 |
| 3,167,936 | A * | 2/1965 | Arne | 464/36 |
| 3,388,751 | A | 6/1968 | Bernaux | |

(Continued)

FOREIGN PATENT DOCUMENTS

| | | |
|---|---|---|
| GB | 2 157 212 | 10/1985 |

(Continued)

*Primary Examiner*—Joseph J Hail, III
*Assistant Examiner*—Robert Scruggs
(74) *Attorney, Agent, or Firm*—Pillsbury Winthrop Shaw Pittman LLP

(57) ABSTRACT

A torque adaptor includes a body, a driving portion that rotates with respect to the body when a threshold torque is exceeded, a receiving portion engageable with a workpiece, and a gear plate that drives the receiving portion. The gear plate is driven by the driving portion, the driving engagement between the driving portion and the gear plate being released when a torque required to drive the gear plate exceeds the threshold torque. An adjusting member adjusts the force of engagement between the driving portion and the gear plate so as to adjust the threshold torque. The receiving portion is moveable along a longitudinal direction of the body between a first position in which the receiving portion engages the body such that a rotation of the driving portion rotates the receiving portion and the rotatable workpiece and a second position in which the receiving portion is disengaged from the body.

46 Claims, 17 Drawing Sheets

U.S. PATENT DOCUMENTS

| | | | | | |
|---|---|---|---|---|---|
| 3,442,360 | A | | 5/1969 | Fulop | |
| 3,535,958 | A | * | 10/1970 | Larson | 81/475 |
| 3,662,628 | A | | 5/1972 | Schnepel | |
| 3,744,350 | A | | 7/1973 | Raff | |
| 3,799,307 | A | | 3/1974 | Tate | |
| 3,942,337 | A | | 3/1976 | Leonard et al. | |
| 4,041,811 | A | | 8/1977 | Durant | |
| 4,062,203 | A | * | 12/1977 | Leonard et al. | 464/38 |
| 4,090,421 | A | * | 5/1978 | Czeczerski | 81/475 |
| 4,262,501 | A | | 4/1981 | Vaughn et al. | |
| 4,272,973 | A | * | 6/1981 | Fu-Tsai | 464/23 |
| 4,328,720 | A | | 5/1982 | Shiel | |
| 4,346,633 | A | * | 8/1982 | Rendl | 81/475 |
| 4,572,041 | A | | 2/1986 | Rissmann | |
| 4,620,428 | A | | 11/1986 | Kopesky | |
| 4,833,951 | A | | 5/1989 | Karcher et al. | |
| 4,833,952 | A | | 5/1989 | Stein et al. | |
| 4,901,610 | A | * | 2/1990 | Larson et al. | 81/473 |
| 4,949,602 | A | | 8/1990 | Letts et al. | |
| 4,964,319 | A | * | 10/1990 | Chang | 81/58.3 |
| 4,991,479 | A | | 2/1991 | Asano et al. | |
| 5,094,330 | A | | 3/1992 | Lee | |
| 5,108,238 | A | | 4/1992 | Ewing | |
| 5,352,231 | A | | 10/1994 | Brumfield et al. | |
| 5,397,269 | A | | 3/1995 | Beaty et al. | |
| 5,415,065 | A | | 5/1995 | McMills | |
| 5,535,867 | A | | 7/1996 | Coccaro et al. | 192/56.1 |
| 5,655,421 | A | | 8/1997 | Haupt | |
| 5,741,987 | A | | 4/1998 | Hrynik et al. | 73/865.8 |
| 5,746,298 | A | | 5/1998 | Krivec et al. | 192/48.3 |
| 5,813,298 | A | | 9/1998 | Beattie | |
| 5,890,406 | A | | 4/1999 | Thorn | |
| 5,950,509 | A | * | 9/1999 | Doong | 81/475 |
| 5,992,272 | A | | 11/1999 | Fortner | |
| 6,309,154 | B1 | | 10/2001 | Higgins | |
| 6,349,625 | B1 | | 2/2002 | Poganski | |
| 6,474,201 | B1 | * | 11/2002 | Lund | 81/124.2 |
| 6,511,268 | B1 | | 1/2003 | Vasudeva et al. | 408/239 R |
| 6,662,693 | B2 | | 12/2003 | Hu | |
| 6,666,117 | B2 | | 12/2003 | Hu | |
| 6,701,813 | B2 | | 3/2004 | Hu | |
| 6,752,050 | B2 | | 6/2004 | Hu | |
| 6,752,051 | B2 | | 6/2004 | Hu | |
| 6,766,717 | B2 | | 7/2004 | Hu | |
| 6,766,718 | B2 | | 7/2004 | Hu | |
| 6,857,983 | B2 | * | 2/2005 | Milbourne et al. | 475/269 |
| 7,080,581 | B2 | | 7/2006 | Reese | 81/75 |
| 2002/0026859 | A1 | | 3/2002 | Suzuki | |
| 2003/0010162 | A1 | | 1/2003 | Hu | |
| 2003/0010163 | A1 | | 1/2003 | Hu | |
| 2003/0079577 | A1 | | 5/2003 | Hu | |
| 2003/0079579 | A1 | | 5/2003 | Hu | |
| 2003/0205114 | A1 | | 11/2003 | Hu | |
| 2004/0065176 | A1 | | 4/2004 | Lin | 81/125 |
| 2004/0182206 | A1 | | 9/2004 | Korpi | |
| 2004/0187652 | A1 | | 9/2004 | Pyre et al. | |
| 2006/0179981 | A1 | | 8/2006 | Cutler et al. | 81/475 |

FOREIGN PATENT DOCUMENTS

| | | |
|---|---|---|
| GB | 2 210 306 | 6/1989 |
| GB | 2 211 772 | 7/1989 |
| JP | 2-256470 | 10/1990 |
| WO | WO 89/05713 | 6/1989 |

* cited by examiner

OVER TORQUE PROOF SOCKET

CROSS REFERENCE TO RELATED APPLICATIONS

The present patent application is a continuation-in-part of co-pending U.S. patent application Ser. No. 11/111,970, filed on Apr. 22, 2005, entitled "Over Torque Proof Socket," the content of which is incorporated herein by reference in its entirety.

BACKGROUND OF THE INVENTION

1. Field of the Invention

The present invention relates to a socket for tightening a workpiece with an adjustable torque.

2. Description of Related Art

Tighteners are generally used in the industry to rapidly tighten nuts, bolts or other workpieces to a receiving part. For example, tighteners may be used to secure spark plugs in internal combustion engines. Referring to FIG. 1, a conventional spark plug tightener 1 conventionally includes an elongated body 2 having a bottom end surface 3 in which a hole is formed with a hexagonal portion. In use, the hexagonal portion of the hole is engaged within the hexagonal casing 4 of the spark plug 5 and the rotation of the elongated body drives and secures the spark plug within the cylinder cover of the engine 6. Rotation of the elongated body 2 may be done manually with a shaft 7 that is passed through the upper portion 8 of the elongated body 2.

Generally, it is desirable to control the transmitted torque for properly securing the workpiece (e.g., the spark plug) to the receiving part (e.g., the engine). The workpiece should not be secured too tightly to ensure that the threads or the holding elements of the receiving part are not fractured or weakened, or that the workpiece is not damaged. Similarly, the workpiece should not be secured too loosely. In order to control the applied torque and to prevent the workpiece from being damaged during tightening, tighteners having a preset amount of torque may be used. Upon reaching that preset amount of torque, the tightener may be arranged to release and spin freely. Alternatively, or in addition, the tightener may include a device to create an audible sound when the torque for which it is set is reached. In this latter configuration, though, the tightener may not completely prevent the user from applying more torque after the signal is given. However, conventional tighteners having a preset amount of torque are generally expensive, heavy and difficult to use in tight environments such as that of many engines. As a result, simpler tools are used in current automotive repair environments and the degree of tightening of many workpieces, such as spark plugs, is left for the most part to the judgment of the user.

SUMMARY OF THE INVENTION

Embodiments of the invention include an adjustable over torque proof socket that is light, small and easy to use for engine repair and maintenance.

In an embodiment of the invention, there is provided an over torque proof socket including: a body having a driving portion adapted to be connected with a torque applying handle, and a receiving portion engageable with a rotatable workpiece, the driving portion being capable of relative rotation with respect to the receiving portion when a threshold amount of torque is exceeded, a first gear portion capable of being operatively driven by rotation of the driving portion in a fastening direction and an opposite releasing direction, a second gear portion functionally cooperable to drive the receiving portion for rotating the workpiece, the second gear portion being constructed and arranged to engage with and be driven by the first gear portion, the driving engagement between the first gear portion and the second gear portion being released when a torque required to drive the second gear portion exceeds the threshold amount of torque. The over torque proof socket also includes a biasing member that applies a force of engagement between the first gear portion and the second gear portion; and an adjusting member functionally cooperable with the biasing member to adjust a magnitude of the force of engagement between the first gear portion and the second gear portion so as to adjust the threshold amount of torque.

In another embodiment of the invention, there is provided an over torque proof socket including a body having a driving portion adapted to be connected with a torque applying handle, and a receiving portion engageable with a rotatable workpiece, the driving portion being capable of relative rotation with respect to the receiving portion when a threshold amount of torque is exceeded. The socket also includes a first gear portion capable of being operatively driven by rotation of the driving portion in a fastening direction and an opposite releasing direction; a second gear portion functionally cooperable to drive the receiving portion for rotating the workpiece, the second gear portion being constructed and arranged to engage with and be driven by the first gear portion. The driving engagement between the first gear portion and the second gear portion is released when a torque required to drive the second gear portion exceeds the threshold amount of torque. The socket further includes a biasing member that applies a force of engagement between the first gear portion and the second gear portion; an adjusting member functionally cooperable with the biasing member to adjust a magnitude of the force of engagement between the first gear portion and the second gear portion so as to adjust the threshold amount of torque; and a magnetic ring configured to retain the workpiece.

In yet another embodiment of the invention, there is provided an over torque proof socket including a body having a driving portion adapted to be connected with a torque applying handle, and a receiving portion engageable with a rotatable workpiece, the driving portion being capable of relative rotation with respect to the receiving portion when a threshold amount of torque is exceeded. The socket also includes a first gear portion capable of being operatively driven by rotation of the driving portion in a fastening direction and an opposite releasing direction; a second gear portion functionally cooperable to drive the receiving portion for rotating the workpiece, the second gear portion being constructed and arranged to engage with and be driven by the first gear portion. The driving engagement between the first gear portion and the second gear portion is released when a torque required to drive the second gear portion exceeds the threshold amount of torque. The socket further includes a biasing member that applies a force of engagement between the first gear portion and the second gear portion; and an adjusting member functionally cooperable with the biasing member to adjust a magnitude of the force of engagement between the first gear portion and the second gear portion so as to adjust the threshold amount of torque. In this embodiment, the driving portion is constructed and arranged to be removably engaged with the first gear portion.

In an embodiment of the invention, there is provided a torque adaptor including a body; a driving portion arranged in the body and adapted to be connected with a torque applying handle, the driving portion being capable of relative rotation with respect to the body when a threshold amount of torque is exceeded; a receiving portion engageable with a rotatable workpiece; a gear plate secured to the body and functionally cooperable to drive the receiving portion for rotating the workpiece, the gear plate being constructed and arranged to engage with and be driven by the driving portion, the driving engagement between the driving portion and the gear plate being released when a torque required to drive the gear plate exceeds the threshold amount of torque. The adaptor also includes a biasing member that applies a force of engagement between the driving portion and the gear plate; and an adjusting member functionally cooperable with the biasing member to adjust a magnitude of the force of engagement between the driving portion and the gear plate so as to adjust the threshold amount of torque, the adjusting member being arranged in the receiving portion.

In yet another embodiment of the invention, there is provided a torque adaptor including a body; a driving portion arranged in the body and capable of relative rotation with respect to the body when a threshold amount of torque is exceeded; a receiving portion engageable with a rotatable workpiece; a gear plate secured to the body and functionally cooperable to drive the receiving portion for rotating the workpiece, the gear plate being constructed and arranged to engage with and be driven by the driving portion, the driving engagement between the first driving portion and the gear plate being released when a torque required to drive the gear plate exceeds the threshold amount of torque. The adaptor also includes an adjusting member to adjust a magnitude of a force of engagement between the driving portion and the gear plate so as to adjust the threshold amount of torque, wherein the receiving portion is moveable along a longitudinal direction of the body between a first position in which the receiving portion engages the body such that a rotation of the driving portion rotates the receiving portion and the rotatable workpiece and a second position in which the receiving portion is disengaged from the body.

In an embodiment of the invention, there is provided a torque adaptor including a driving portion adapted to be connected with a torque applying handle and a receiving portion engageable with a rotatable workpiece, the driving portion being capable of relative rotation with respect to the receiving portion when a threshold amount of torque is exceeded. The adaptor also includes a first gear portion capable of being operatively driven by rotation of the driving portion in a fastening direction and an opposite releasing direction and a second gear portion slideably arranged within the receiving portion. The second gear portion is functionally cooperable to drive the receiving portion for rotating the workpiece, the second gear portion being constructed and arranged to engage with and be driven by the first gear portion, the driving engagement between the first gear portion and the second gear portion being released when a torque required to drive the second gear portion exceeds the threshold amount of torque. The adaptor further includes a biasing member that applies a force of engagement between the first gear portion and the second gear portion; and an adjusting member functionally cooperable with the biasing member to adjust a magnitude of the force of engagement between the first gear portion and the second gear portion so as to adjust the threshold amount of torque, the adjusting member being arranged in the receiving portion.

BRIEF DESCRIPTION OF THE DRAWINGS

Embodiments of the invention will now be described, by way of example only, with reference to the accompanying drawings in which corresponding reference symbols indicate corresponding parts, and in which.

DETAILED DESCRIPTION OF THE INVENTION

Figure 2:
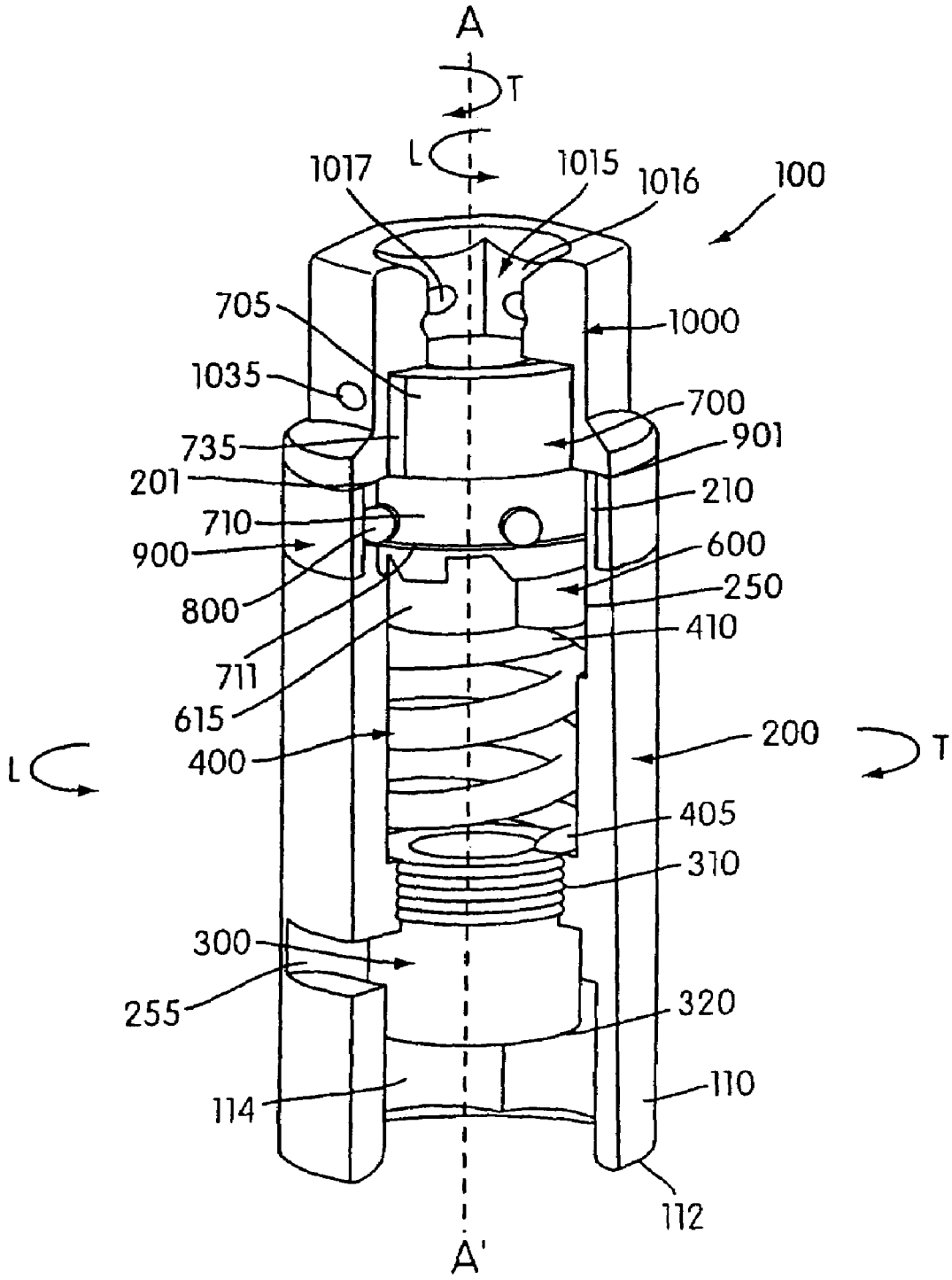
FIG. 2 is a perspective view, partly in section, of the over torque proof socket in accordance with an embodiment of the invention.

FIG. 2 shows a perspective view, partly in section, of the over torque proof socket, generally shown as 100, for selectively applying a torque to a workpiece, and which embodies the principles of the present invention. In an embodiment of the invention, the workpiece is a spark plug and the over torque proof socket 100 is configured to secure the spark plug to an engine. However, it will be appreciated that the over torque proof socket 100 may be configured in other embodiments of the invention to secure any type of workpiece or fastener such as, for example, a bolt or a nut.

Figure 1:
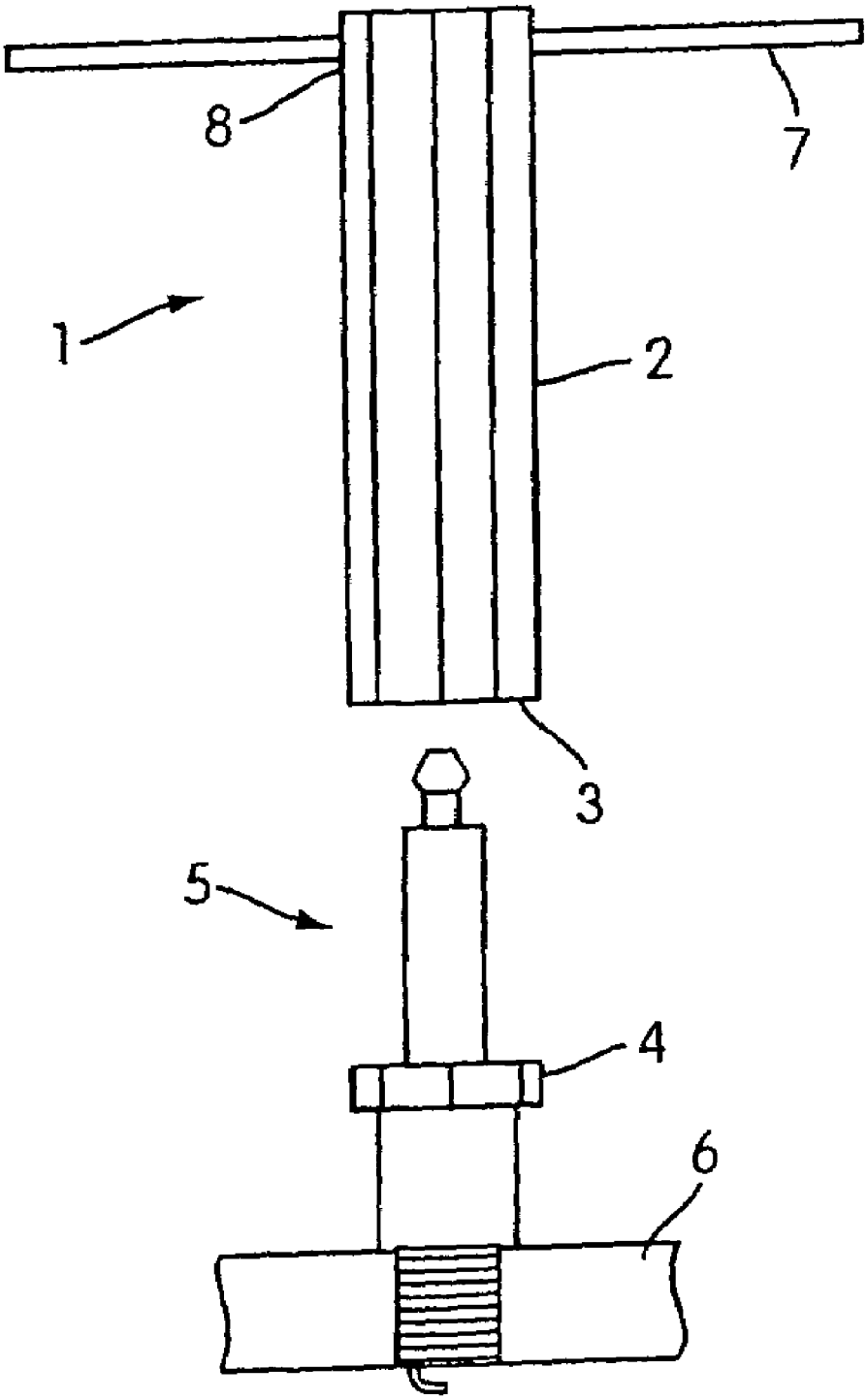
FIG. 1 is a schematic representation of a spark plug and a conventional spark plug tightener.

FIG. 2 shows the main components of the socket 100 which includes a body 200. The body 200 includes a driving portion 1000 and a receiving portion, generally shown at 110. The receiving portion 110 has at one end 112 thereof a peripheral interior surfaces 114 defining multi-faceted interior shape, for engaging a multi-faceted workpiece. In the embodiment shown, surfaces 114 define a hexagonal interior shape for engaging the hexagonal casing of a workpiece to be rotationally secured. The workpiece may be a spark plug such as the one shown in FIG. 1. An outside ring 900 is slideably arranged on a protruding portion, generally shown as 210, of the receiving portion 110. As shown, protruding portion 210 has a thinner wall thickness than portions of the body 200 therebelow. In particular, it has a smaller outer diameter to accommodate the thickness of outer ring 900, which has an outer diameter of approximately the same dimension as the lower portions of body 200, so that the outer surfaces are generally flush. The driving portion 1000 has a lower surface that is constructed and arranged to rest on the top radial surfaces 201 and 901 of, respectively, the receiving portion 110 and the outside ring 900. A torque applying member, such as a conventional wrench, may be used to engage the top square cavity 1015 of the driving portion 1000 such that torque applied to the driving portion 1000 is transmitted to the body 200 to effect rotation thereof. In an embodiment, a square drive wrench such as a ratchet wrench may be used to engage the top square cavity 1015. In another embodiment, square drive wrench handles without a ratchet may also be used to engage the top square cavity 1015.

Figure 8A:
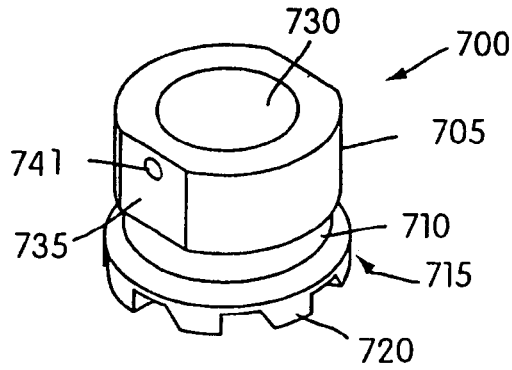
FIGS. 8*a-f* show several views of the top gear plate for use in the socket in accordance with an embodiment of the invention.
Figure 8B:
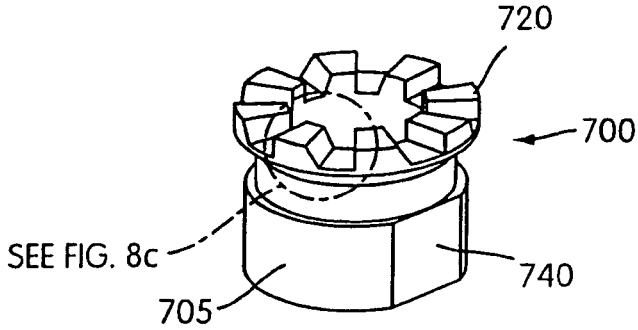
Figure 8C:
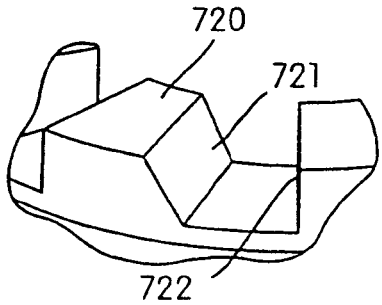
Figure 11A:
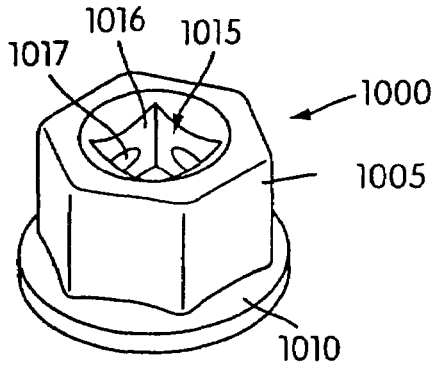
FIGS. 11*a-f* show several views of a driving portion for use in the socket in accordance with an embodiment of the invention.
Figure 11B:
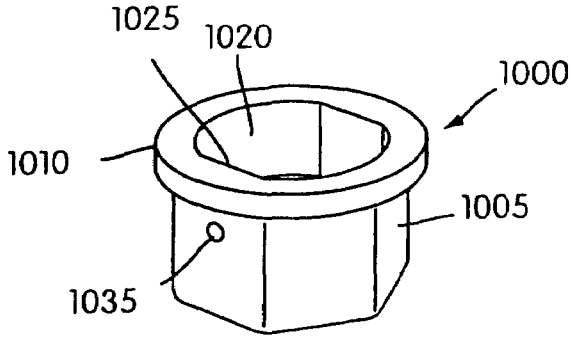
Figure 11C:
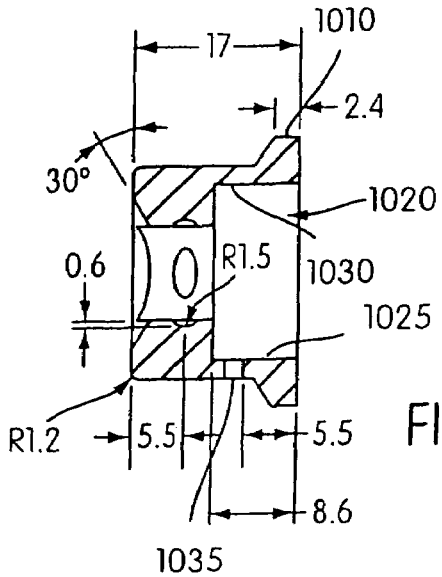
Figure 11D:
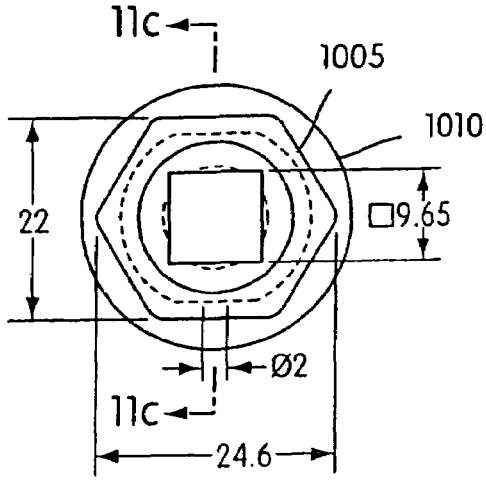
Figure 11E:
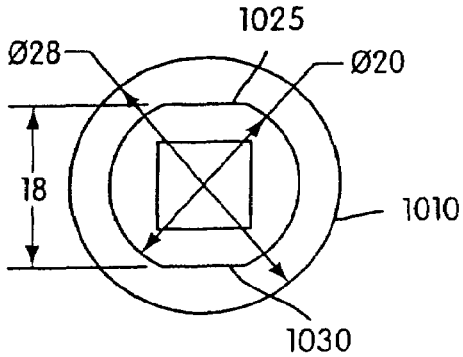

The socket 100 also includes an adjusting member 300, a biasing member 400, a first gear portion 700 and a second gear portion 600 that are arranged inside the body 200. The driving portion 1000 is constructed and arranged to drive the first gear portion 700. In the embodiment shown in FIG. 2, the driving portion 1000 is secured to the first gear portion 700 via a pin 1040 that is inserted into the lateral holes 1035 and 740 of respectively the driving portion 1000 and the first gear portion 700 (see FIGS. 8*a*, 11*b* and 11*f*). The driving portion 1000 may be disengaged from the first gear portion 700 by removing the pin 1040. In that way, the driving portion 1000 can easily be switched from one size to another, for example, from a ½" drive to a ⅜" drive.

Figure 3A:
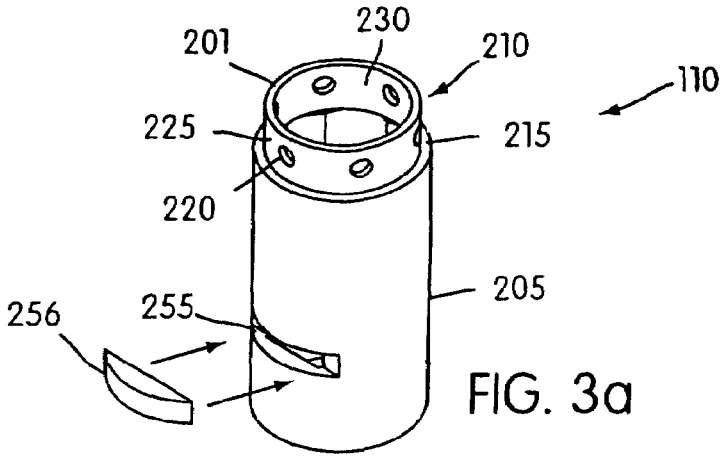
FIGS. 3*a-d* show several views of the main body of the socket in accordance with an embodiment of the invention.
Figure 8D:
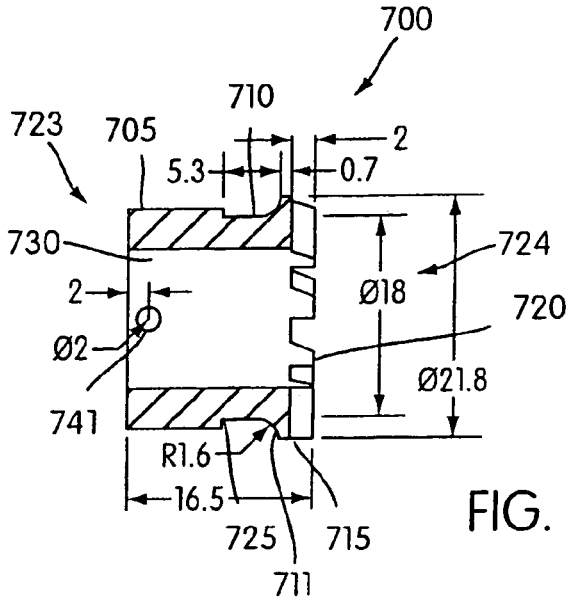
Figure 8E:
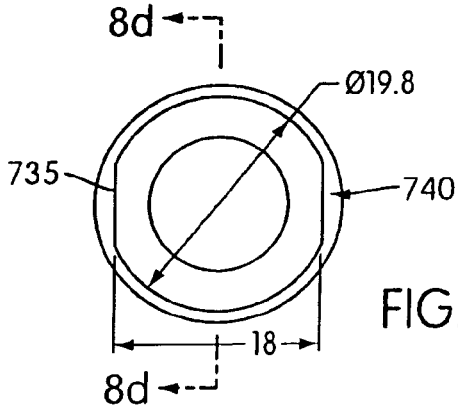
Figure 8F:
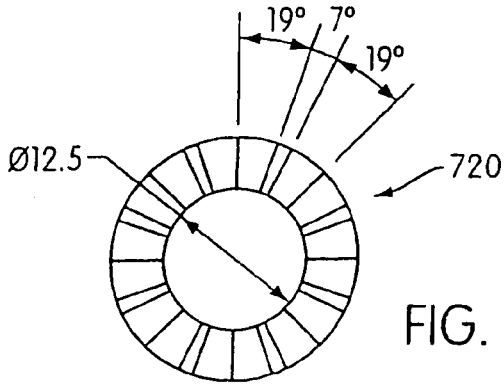

A plurality of ball bearings 800 are arranged between the intermediate portion 710 of the first gear portion 700 and the cylindrical inner surface 230 of the protruding portion 210 of the receiving portion 110. The ball bearings 800 are constructed and arranged to secure the first gear portion 700 to the receiving portion 110. Specifically, the ball bearings 800 are constructed and arranged such that a portion thereof can be retained in the equally spaced holes 220 (see FIG. 3*a*) while another portion thereof can rest on the curved lower portion 711 of the intermediate portion 710 (see FIG. 8*d*). The curved lower portion 711 of the intermediate portion 710 may be shaped to conform the surface of the ball bearings 800. The ball bearings 800 secure the first gear portion 700 to the receiving portion 110 despite the axial force exerted by the biasing member 400 to the first gear portion 700 via the second gear portion 600, which force acts to move the second gear portion 600 and the first gear portion 700 towards the end 111 of the receiving portion 110.

The first gear portion 700 is engaged with the second gear portion 600. The second gear portion 600 is rotationally secured within the receiving portion 110 so that rotation of the second gear portion 600 about axis AA' rotates the receiving portion. The rotation of the second gear portion 600 is translated into rotational movement of the receiving portion 110 as a result of the conforming shapes of the exterior surface 615 of the second gear portion 600 and interior surface portion 250 of receiving portion 110. These conforming surface shapes prevent relative rotation between parts, but permit some degree of axial movement of second gear portion 600 relative to receiving portion 110.

The first gear portion 700 and the second gear portion 600 are provided at their confronting faces with a plurality of teeth 720, 620, which, as viewed in one direction of turning the socket 100, have flanks 721, 630, of shallow inclination and, as viewed in the opposite direction, have sharp flanks 722, 635. In the tightening or fastening direction (labeled as "T" in FIG. 2), the flanks of shallow inclination 721 of the first gear portion 700 are biased against the flanks of shallow inclination 630 of the second gear portion 600. By contrast, in the loosening or releasing direction (labeled as "L" in FIG. 2), the sharp flanks 722 of the first gear portion 700 are biased against the sharp flanks 635 of the second gear portion 600. The biasing member 400 is slideably arranged inside the body 200 and biases at one end thereof (e.g., 405) the lower surface 625 of the second gear portion 600 and rests at the other end thereof (e.g., 410) on an end bearing surface 330 of the adjusting member 300. The biasing member 400 and the adjusting member 300 are intended to work in unison to set the desired threshold level of torque for the socket 100.

Operation of the socket 100 will now be described in greater detail with reference to FIGS. 3-11. The adjusting member 300 is provided with an exterior surface threaded portion 310 that is received by threads 241 formed on an exterior surface portion 240 of the receiving portion 110. In addition, the adjusting member 300 has a hexagonal cavity 320 defined by six surfaces 321 (see FIG. 4*b*, illustrated three of such surfaces). The cavity 320 is accessible through the open end 112 of the body 200. Engaging the hexagonal surfaces defining cavity 320 enables adjusting member 300 to be screwed up or down inside the body 200 in order to set the required level of torque. A displacement of the adjusting member 300 toward the driving portion 1000 compresses the biasing member 400, thereby increasing its level of stress. Conversely, a displacement of the torque adjusting member 300 toward the opposite end 112 of the body 200 loosens the biasing member 400, thereby reducing its level of stress. The biased force exerted by the biasing member 400 on the second gear portion 600 is transmitted to the first gear portion 700.

As the driving portion 1000 is rotated in the tightening or fastening direction with a torque applying member, such as a wrench, it directly drives the first gear portion 700, which is rotationally fixed relative to the driving portion 1000. Since the plurality of teeth 720 of the first gear portion 700 are engaged with the plurality of teeth 620 of the second gear portion 600, rotation of the first gear portion 700 drives the second gear portion 600, which in turn drives the receiving portion 110 until the torque exerted by the torque applying member exceeds the torsional resistance offered by the biasing member 400 via the engagement between the first and second gear portions 700 and 600. During rotation of the socket 100 in the tightening or fastening direction, the flanks of shallow inclination 721 of the first gear portion 700 will begin to slide over the flanks of shallow inclination 630 of the second gear portion 600, as the threshold force set by the adjusting member 300 is approached.

Specifically, the engaged shallow flank surfaces apply an axial force upon second gear portion 600. When that force increases towards the threshold level set by the axial position of adjusting member 300, the spring 400 starts to compress under the force of axial movement of second gear portion 600, which axial movement is imparted to second gear portion 600 through the forced engagement between the shallow teeth surfaces 721, 630 of first and second gear portion 700 and 600.

Upon exceeding the torsional resistance offered by the biasing member 400, the plurality of teeth 720 on the first gear portion 700 disengage from the plurality of teeth 620 on the second gear portion 600 and the manual force applied by the torque applying member rotates the assembly formed by the driving portion 1000 and the first gear portion 700 relative to the receiving portion 110. Conversely, when the driving portion 1000 is rotated in the loosening direction or the releasing direction, i.e., the direction opposite the tightening direction, the sharp flanks 722 of the first gear portion 700 are forced against the sharp flanks 635 of the second gear portion 600 such that substantially no axial forces are transmitted to second gear portion 600 and no slippage between the first gear portion 700 and the second gear portion 600 can occur. In one embodiment, the sharp flank surfaces 722 and 635 are parallel to the axis AA' of the device 100.

Referring now to FIGS. 3*a-d*, these figures show different views of the receiving portion of the socket 100 in accordance with an embodiment of the invention. The receiving portion 110 includes a cylindrical housing 205, which at the upper end thereof is provided with the protruding portion 210 at the indicated recess 215. The protruding portion 210 includes a cylindrical outer surface 225 and a cylindrical inner surface 230, which are provided with a plurality of equally spaced holes 220. The plurality of equally spaced holes 220 are constructed and arranged to receive a portion of the ball bearings 800, while another portion thereof is arranged in the intermediate portion 710 of the first gear portion 700. The curved lower portion 711 of the intermediate portion 710 may be shaped to conform the surface of the ball bearings 800. The ball bearings 800 secure the first gear portion 700 to the receiving portion 110.

Figure 3B:
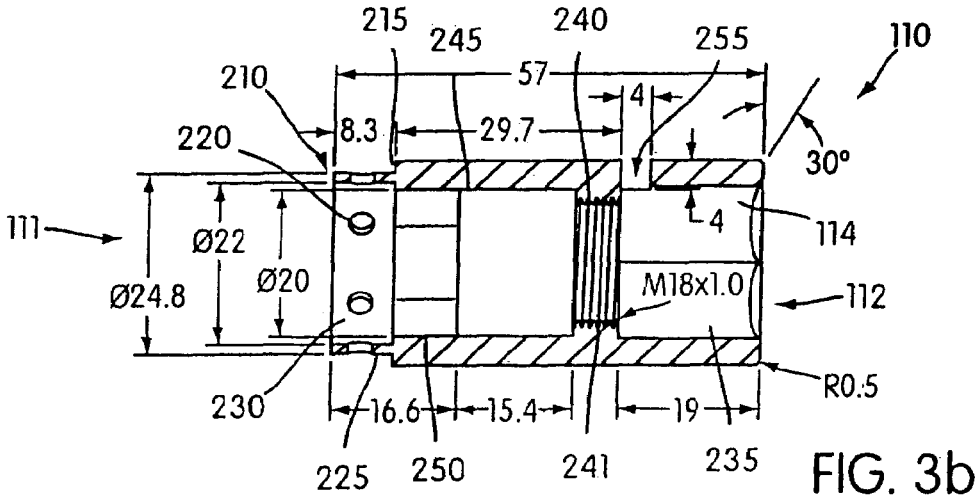
Figure 3C:
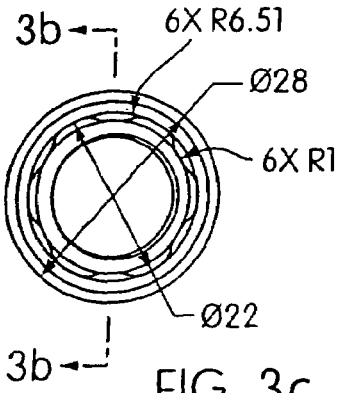
Figure 3D:
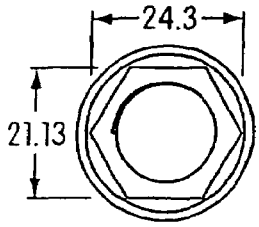
Figure 4A:
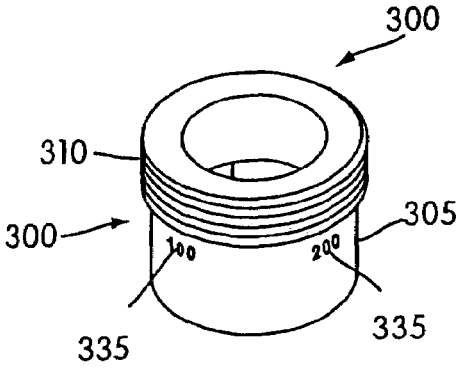
FIGS. 4*a-d* show an adjusting member in accordance with an embodiment of the invention.
Figure 4B:
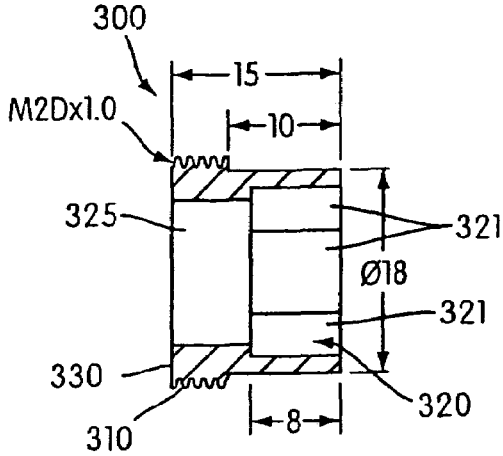
Figure 4C:
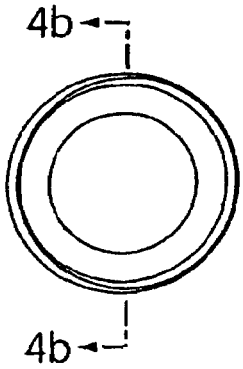
Figure 4D:
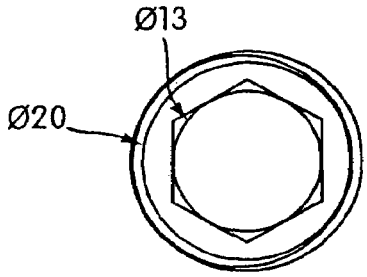

As best seen in FIG. 3*b*, the interior part of the cylindrical housing 205 also includes a lower portion 235, the intermediate threaded portion 240, a cylindrical housing 245, and an upper surface portion 250. The lower portion 235 of the receiving portion 110 is constructed and arranged to engage the casing of the workpiece to effect rotation thereof. In FIGS. 3*a-d*, the inner wall or surfaces 114 of the lower portion 235 is hexagonally shaped. However, it will be appreciated that any shape suitable to engage the casing of the spark plug may be used for the lower portion 235.

Referring now more particularly to FIGS. 4*a-d*, the intermediate threaded portion 240 is configured to receive the external threaded portion 310 of the adjusting portion 300. The adjusting member 300 consists of a cylindrical hollowed housing 305 including at one end thereof the external threaded portion 310. The inner part of the cylindrical hollowed housing 305 is substantially divided between a first portion 320 having an hexagonal shaped wall defined by surfaces 321 and a second portion 325 having a cylindrical shaped wall. The first portion 320 is dimensioned so as to receive the correspondingly shaped surfaces of the workpiece, e.g., a spark plug, during operation of the socket 100. The adjusting member 300 is rotated by detachable connection with, for example, a ratchet via a head thereof which fits into the cavity formed by the first portion 320. The cylindrical hollowed housing 305 includes an end bearing surface 330 that is arranged at one end of the external threaded portion 310. The bearing surface 330 extends inwardly from the external threaded portion 310 to the hexagonal shaped wall of the second portion 325 and is configured to bear one end of the biasing member 400 shown in FIG. 5.

Figure 5:
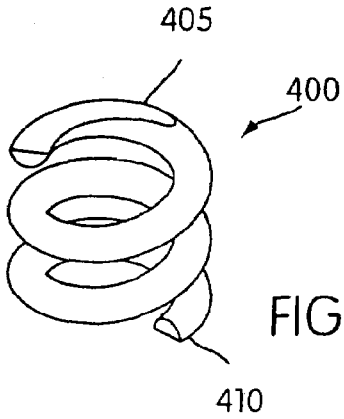
FIG. 5 shows a biasing member for use in the socket in accordance with an embodiment of the invention.

As can be seen in FIG. 5, the biasing member 400 may be a compression spring. In one embodiment, the spring comprises between two and three coils. The compression spring 400 is grounded at both extremities thereof to provide a first flat extremity 405 and a second flat extremity 410. One of the first and second flat extremities 405 and 410 rests on the aforementioned bearing surface 330 of the driving member 300, while the other extremity is configured to bias the bottom gear plate 600, shown in FIG. 7, so as to keep the second gear portion engaged with the first gear portion 700. The ground surfaces increase the surface area of contact between the compression spring 400 and the second gear portion 600 or the torque adjusting member 300. As a result, the efforts generated by rotation of the torque adjusting member 300 will be more equally distributed throughout the compression spring 400 and the second gear portion 600.

The biasing member 400 is dimensioned so as to be slideably arranged within the cylindrical housing 245 of the receiving member shown in FIG. 3. As the adjusting member 300 is screwed up in the direction of the driving portion 1000 shown in FIG. 2, the stress level in the biasing member 400, or compression spring, is increased. The assembly formed by the biasing member 400 and the adjusting member 300 may be calibrated to inform the operator of the socket 100 of the target torque at which the socket 100 operates. To that effect, markings 335 showing the target torque may be provided on the exterior surface of the cylindrical hollowed housing 305. Such markings may be visible through a window 255 arranged in the body 200 of the socket. In an embodiment of the invention, a transparent cap 256 may be inserted in the window 255 to protect the markings 335 during operation of the socket 100.

Figure 6A:
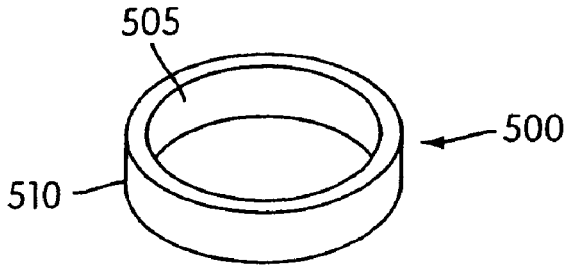
FIGS. 6*a-b* show several views of a workpiece retaining element in accordance with embodiment of the invention.
Figure 6B:
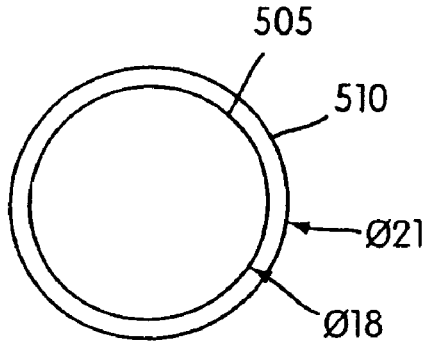
Figure 6C:
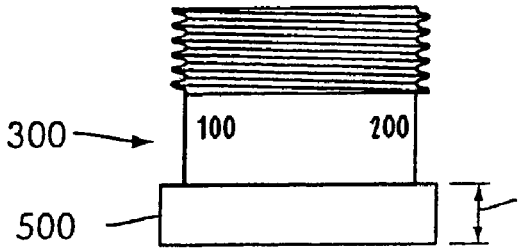
FIG. 6*c* shows a view of a workpiece retaining element mounted to the adjusting member in accordance with an embodiment of the invention.
Figure 6D:
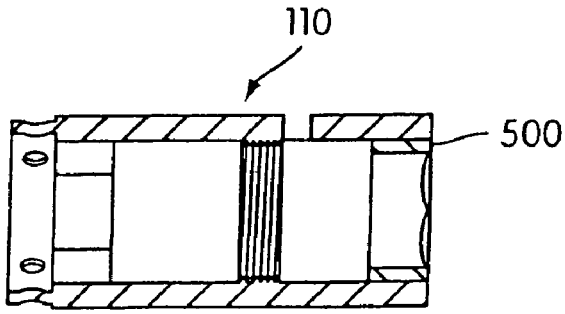
FIG. 6*d* shows a view of a workpiece retaining element mounted to the workpiece retaining portion in accordance with an embodiment of the invention.

A workpiece retaining element 500 may be used in an embodiment of the invention to retain the workpiece once it is removed, e.g., to retain the spark plug. The workpiece retaining element 500 may be a magnetic ring such as the one shown in FIGS. 6*a-b*, which is slideably inserted around the exterior surface of the cylindrical hollowed housing 305, as shown in FIG. 6*c*. Alternatively, the workpiece retaining element 500 may be an o-ring arranged in the lower portion 205 of the receiving portion 110, as shown in FIG. 6*d*. Where a magnetic ring is used for the retaining element 500, as shown in FIG. 6*c*, the magnetic ring 500 includes an outer wall 510 and an inner wall 505 that has substantially the same diameter as that of the exterior surface of the cylindrical hollowed housing 305. The magnetic ring 500 may be positioned so as not to impair reading of the markings 335 through the window 255. Alternatively, the magnetic ring 500 may be positioned proximate the threaded portion 310 of the cylindrical hollowed housing 305 and the markings may be provided on the magnetic ring 500.

Figure 7A:
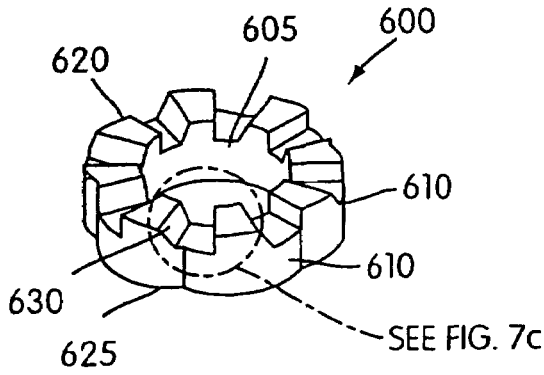
FIGS. 7*a-c* show several views of the bottom gear plate for use in the socket in accordance with an embodiment of the invention.
Figure 7B:
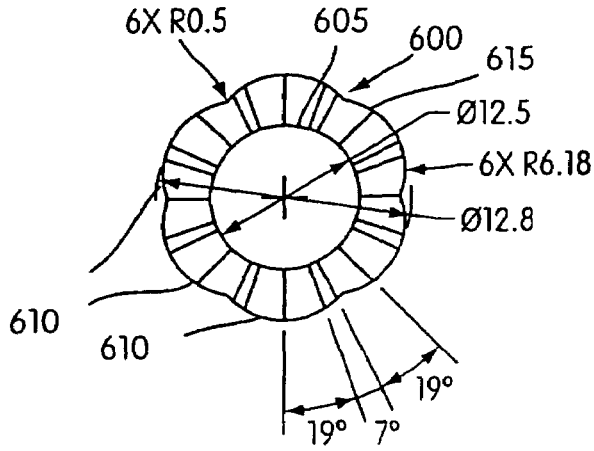
Figure 7C:
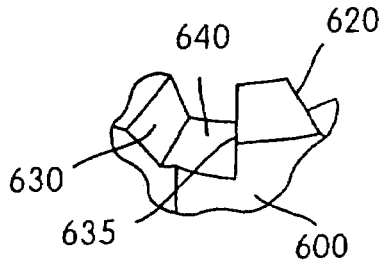

FIGS. 7*a-c* show several views of the second gear portion 600 in accordance with an embodiment of the invention. The second gear portion 600 includes a cylindrical inner wall portion 605 and an outer wall portion or exterior surface 615 having a male hexagonal spline. The male hexagonal spline consists of a plurality of arcs 610, which define the contour of the outer wall portion 615. In this embodiment of the invention, the male hexagonal spline includes six connected arcs 610 that have substantially the same radius of curvature. However, it will be appreciated that a second gear portion 600 with a male polygonal spline including fewer or more than six arcs can also be used in another embodiment of the invention.

The second gear portion 600 includes a plurality of teeth 620 provided at one end thereof and a bias surface 625, which is contacted by one of the first and second flat extremities 405 and 410 of the biasing member 400. The teeth 620 have a trapezoidal shape and extend from the outer wall portion 615 to the cylindrical inner wall portion 605 of the second gear portion 600. The teeth 620 also have flanks of shallow inclination 630 and sharp flanks 635 that are substantially perpendicular to the upper surface 640 that extends between adjacent teeth. The second gear portion 600 is arranged in the upper portion 250 of the receiving portion 110. The interior wall of the upper portion 250 includes a corresponding polygonal spline to prevent rotation of the second gear portion 600. It will be appreciated that a different outer wall profile and corresponding interior wall of, respectively, the second gear portion 600 and the receiving portion 110 may also be used in other embodiments of the invention.

The plurality of teeth 620 of the second gear portion 600 are configured to engage the corresponding plurality of teeth 720 of the first gear portion, generally shown as 700 in FIGS. 8*a-f*. The first gear portion 700 has a cylindrical hole formed therethrough and includes an upper portion 705, the intermediate portion 710, and a toothed circular plate 715 on which the corresponding plurality of teeth 720 is provided. The intermediate portion 710 is arranged at the indicated recess 725 between the upper portion 705 and the toothed circular plate 715. The inner wall 730 defining the hole extends from one end 723 to the other end 724 of the first gear portion 700. The outer wall upper portion 705 has a generally cylindrical shape on which two parallel flat portions 735 and 740 are provided. The flat portion 735 includes a lateral hole 741 formed therethrough for attachment, via a pin 1040, with the driving portion 1000 shown in FIG. 11.

Figure 9:
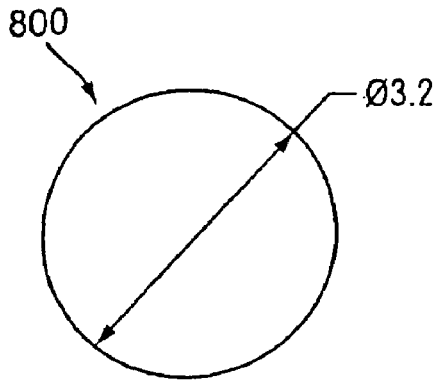
FIG. 9 shows a steel ball for use in the socket in accordance with an embodiment of the invention.
Figure 10A:
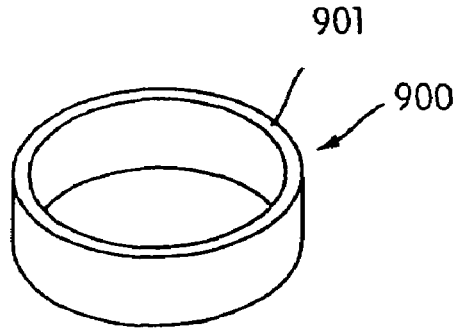
FIGS. 10*a-c* show several views of an outside ring for use in the socket in accordance with an embodiment of the invention.
Figure 10B:
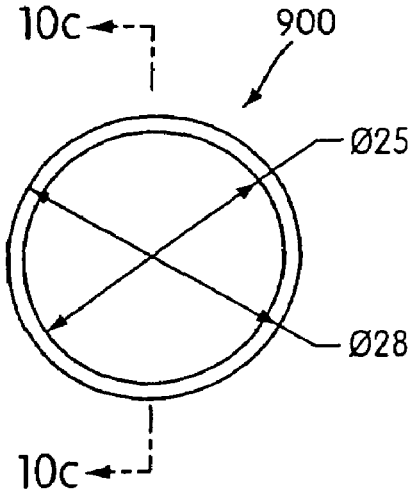
Figure 10C:
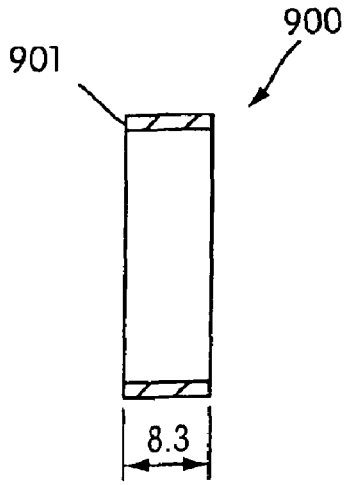

The first gear portion 700 is arranged within the protruding portion 230 of the receiving portion 110 and abuts the second gear portion 600, as best seen in FIG. 2. A plurality of ball bearings 800 having a portion thereof retained by the plurality of holes 220 are disposed within the intermediate portion 710 to secure the first gear portion 700 to the receiving portion 110. FIG. 9 shows a steel ball that can be used in an embodiment of the invention. In another embodiment, cylindrical rollers may be substituted for the ball bearings 800 to secure the first gear portion 700 to the receiving portion 110. Specifically, the cylindrical rollers may be constructed and arranged such that a first end portion thereof is retained in the plurality of holes 220 while a second end portion thereof is engaged with the intermediate portion 710 of the first gear plate 700. FIGS. 10*a-c* show the outside ring 900 that is slideably arranged on the outer portion 225 of the receiving portion 110.

Figure 11F:
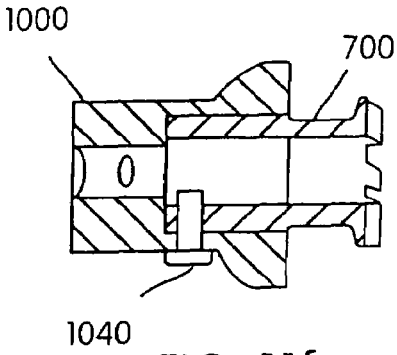

Referring now to FIGS. 11*a-e*, these figures show several views of the driving portion that is constructed and arranged to be cooperatively engaged with the first gear portion 700 to drive the receiving portion 110. The driving portion, generally shown as 1000, may be a hexagonal cap that includes a hexagonal portion 1005 having an outward flange 1010 at one end thereof. The driving portion 1000 includes a first cavity 1015 provided at a first end thereof and a second cavity 1020 provided at a second end thereof. The second cavity 1020 has a generally cylindrical interior wall with parallel flat portions 1025 and 1030 that is configured to engage the upper portion 705 of the first gear portion 700. The driving portion 1000 is rotated by detachable connection with a head of a ratchet (not shown) that engages the first cavity 1015. Lateral recesses 1017 may be arranged on each side 1016 of the first cavity 1015. Those lateral recesses 1017 may be used to cooperate with protruding portions of the ratchet head (not shown) to secure such head to the driving portion 1000. A lateral hole 1035 is formed through the flat portion 1025 to cooperate with the lateral hole 741 formed in the flat portion 735 of the first gear portion 700. A pin 1040 may be used to secure the first gear portion 700 with the hexagonal cap 1000, as shown in FIG. 11*f*.

The assembly formed by the second gear portion 600 and the first gear portion 700 enables the operator to accurately control tightening/fastening of the workpiece. In the tightening or fastening direction, the shallow inclined flanks 721 of the first gear portion 700 are forced against the shallow inclined flanks 730 of the second gear portion 600. The inclination of these flanks may in the range of about 111°-121° in an embodiment of the invention. When the torque transmitted by a torque applying member to the first gear portion 700, via the driving portion 1000, reaches the target or threshold torque exerted by the biasing portion 400, the shallow inclined flanks 721 of the top gear plate 700 begin to slide over the shallow inclined flanks 730 of the second gear portion 700. Upon exceeding the target torque, the plurality of teeth 720 of the first gear portion 700 disengage from the plurality of teeth 620 of the second gear portion 600 and the assembly formed by the first gear portion 700 and the driving portion 1000 freely rotates about the central axis AA' of the body 200. In the loosening direction, the plurality of teeth 720 of the first gear portion 700 remains engaged with the plurality of teeth 620 of the second gear portion 600 irrespective of the applied torque because the sharp flanks 722, 635 prevent any slippage between these two portion.

Figure 12:
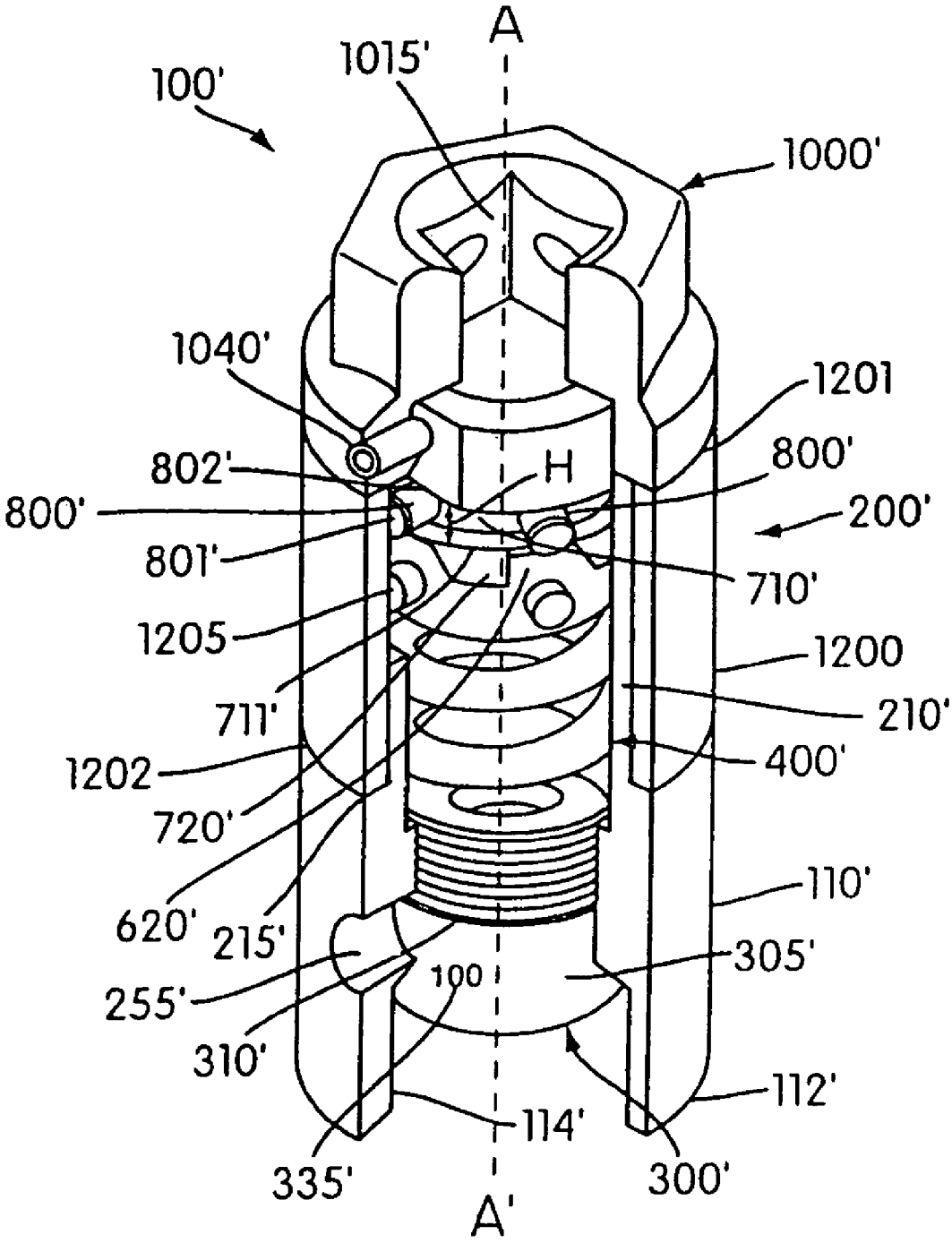
FIG. 12 is a perspective view, partly in section, of the over torque proof socket in accordance with an embodiment of the invention.
Figure 13:
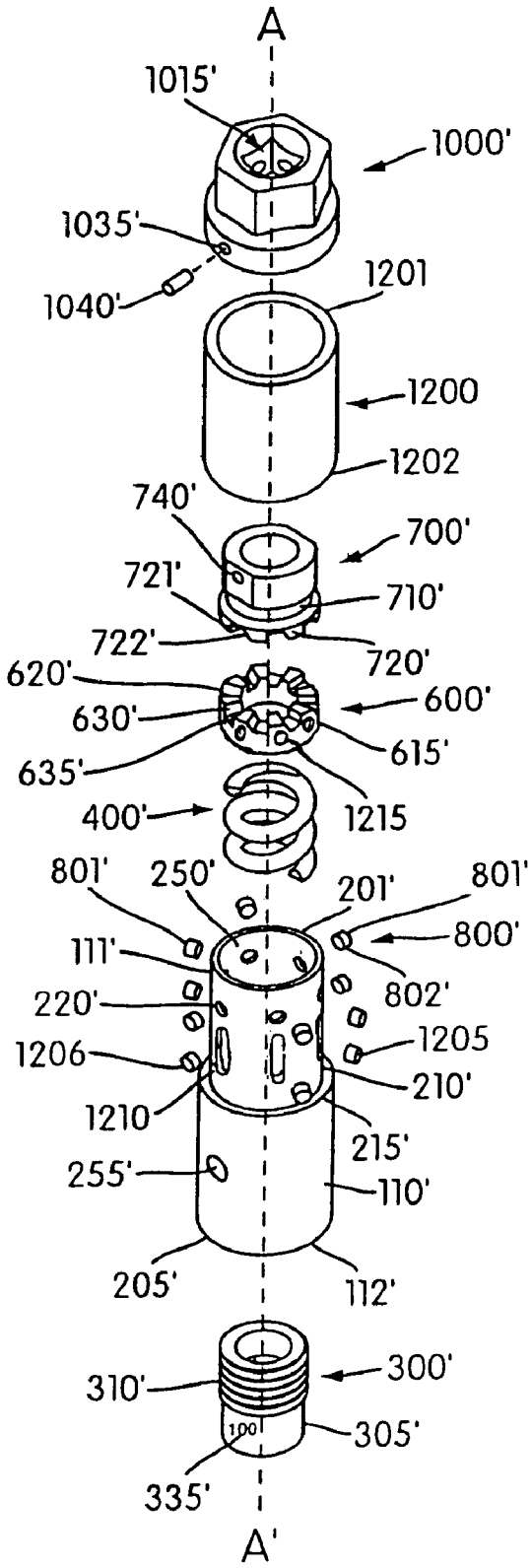
FIG. 13 is an exploded view of the over torque proof socket shown in FIG. 12.

FIGS. 12 and 13 show respectively a perspective view, partly in section, and an exploded view of the over torque proof socket 100' in accordance with another embodiment of the invention. Similarly to the embodiment shown in FIG. 2, the socket 100' includes a body 200', which includes a driving portion 1000' and a receiving portion, generally shown at 110'. The workpiece receiving portion 110' has at one end 112' thereof a peripheral interior surfaces 114' defining multi-faceted interior shape, for engaging a multi-faceted workpiece. In the embodiment shown, surfaces 114' define a hexagonal interior shape for engaging the hexagonal casing of a workpiece to be rotationally secured. The workpiece may be a spark plug such as the one shown in FIG. 1.

An outer cylindrical ring 1200 is slideably arranged on a protruding portion, generally shown as 210', of the receiving portion 110'. As shown in FIG. 12, when the outer cylindrical ring 1200 is fully engaged with the protruding portion 210', the outer cylindrical ring 1200 abuts the recess portion 215' such that the bottom radial surface 1202 of the cylindrical ring 1200 rests on the recess portion 215' of the receiving portion 110'. As shown, protruding portion 210' has a thinner wall thickness than portions of the body 200' therebelow. In particular, protruding portion 210' has a smaller outer diameter to accommodate the thickness of outer cylindrical ring 1200, which has an outer diameter of approximately the same dimension as the lower portions of body 200', so that the outer surfaces are generally flush. The driving portion 1000' has a lower surface that is constructed and arranged to rest on the top radial surfaces 201' and 1201 of, respectively, the receiving portion 110' and the outer cylindrical ring 1200. A torque applying member, such as a conventional wrench, may be used to engage the top square cavity 1015' of the driving portion 1000' such that torque applied to the driving portion 1000' is transmitted to the body 200' to effect rotation thereof. In an embodiment, a square drive wrench such as a ratchet wrench may be used to engage the top square cavity 1015'. In another embodiment, square drive wrench handles without a ratchet may also be used to engage the top square cavity 1015'.

Similarly to the embodiment of FIG. 2, the socket 100' also includes an adjusting member 300', a biasing member 400', a first gear portion 700' and a second gear portion 600' that are arranged inside the body 200'. The driving portion 1000' is constructed and arranged to drive the first gear portion 700'. In the embodiment shown in FIGS. 12-13, the driving portion 1000' is secured to the first gear portion 700' via a pin 1040' that is inserted into the lateral holes 1035' and 740' of respectively the driving portion 1000' and the first gear portion 700'.

The driving portion 1000' may be disengaged from the first gear portion 700' by removing the pin 1040'.

As can be seen in FIGS. 12-13, a plurality of linear rollers 800' are arranged between the intermediate portion 710' of the first gear portion 700' and the cylindrical inner surface 250' of the protruding portion 210' of the receiving portion 110'. The linear rollers 800' have a generally cylindrical shape and are constructed and arranged to secure the first gear portion 700' to the receiving portion 110'. Specifically, the linear rollers 800' are constructed and arranged such that a first end portion thereof 801' is retained in the equally spaced holes 220' located on the protruding portion 210' while a second end portion thereof 802' is engaged with the intermediate portion 710' of the first gear plate 700'.

In this embodiment, the intermediate portion 710' is dimensioned to receive the second end portion 802' and has a height (labeled as "H" in FIG. 12) that is slightly larger than a diameter of the linear rollers 800'. The first end portion 801' of the linear rollers 800' is slideably arranged within the equally spaced holes 220' such that the linear rollers 800' are allowed to rotate about their longitudinal axis that extends from the first end portion 801' to the second end portion 802'.

The linear rollers 800' secure the first gear portion 700' to the receiving portion 110' despite the axial force exerted by the biasing member 400' to the first gear portion 700' via the second gear portion 600', which force acts to move the second gear portion 600' and the first gear portion 700' towards the end 111' of the receiving portion 110'. The axial force exerted by the biasing member 400' applies a force of engagement between the bottom surface 711 ' of the intermediate portion 710' and the linear rollers 800', such that when the first gear plate 700' rotates about the AA' axis, the linear rollers 800' rotate about their longitudinal axis. During rotation of the linear rollers 800' about their longitudinal axis, the second end portion 802' of each roller 800' rolls over the bottom surface 711' of the intermediary portion 710'.

The first gear portion 700' is engaged with the second gear portion 600'. The second gear portion 600' is rotationally secured within the receiving portion 110' via a plurality of cylindrical wedges 1205 so that rotation of the second gear portion 600' about axis AA' rotates the receiving portion 110'. The inner surface 250' of the protruding portion 210' is substantially cylindrical and is configured to receive the exterior surface 615' of the second gear plate 600'. The cylindrical wedges 1205 are constructed and arranged such that a portion thereof is retained in the equally spaced holes 1215, which are radially arranged on the exterior surface 615' of the second gear plate 600', while another portion thereof is retained in the equally spaced slots 1210, which are radially arranged on the protruding portion 210' of the retaining portion 110'. The plurality of wedges 1215 hold and guide the second gear portion 600' along the slots 1210 when the torque is changed via the adjusting member 300'.

In the embodiment shown in FIGS. 12-13, the wedges 1205 are arranged such that an end portion 1206 of the wedges 1205 and the outer surface of the protruding portion 210' are substantially flush. Similarly, the outer cylindrical ring 1200 is constructed and arranged to be slideably arranged within the protruding portion 210' and has an outer diameter of approximately the same dimension as the lower portions of body 200', so that the outer surfaces are generally flush.

Operation of the socket 100' is performed substantially the same way as in the embodiment of the FIG. 2. The adjusting member 300' is provided with an exterior surface threaded portion 310' that is received by threads formed on an exterior surface portion of the receiving portion 110' (not shown in FIGS. 12-13). The adjusting member 300' may be screwed up or down inside the body 200' in order to set the required level of torque. A displacement of the adjusting member 300' toward the driving portion 1000' compresses the biasing member 400', thereby increasing its level of stress. Conversely, a displacement of the torque adjusting member 300' toward the opposite end 112' of the body 200' loosens the biasing member 400', thereby reducing its level of stress. During such displacements, the second gear portion 600' is guided along the slots 1210. The biased force exerted by the biasing member 400' on the second gear portion 600' is transmitted to the first gear portion 700'.

As the driving portion 1000' is rotated in the tightening or fastening direction with a torque applying member, such as a wrench, it directly drives the first gear portion 700', which is rotationally fixed relative to the driving portion 1000'. Since the plurality of teeth 720' of the first gear portion 700' are engaged with the plurality of teeth 620' of the second gear portion 600', rotation of the first gear portion 700' drives the second gear portion 600', which in turn drives the receiving portion 110' until the torque exerted by the torque applying member exceeds the torsional resistance offered by the biasing member 400' via the engagement between the first and second gear portions 700 and 600. During rotation of the socket 100' in the tightening or fastening direction, the flanks of shallow inclination 721' of the first gear portion 700' will begin to slide over the flanks of shallow inclination 630' of the second gear portion 600', as the threshold force set by the adjusting member 300' is approached.

Specifically, the engaged shallow flank surfaces apply an axial force upon second gear portion 600'. When that force increases towards the threshold level set by the axial position of adjusting member 300', the spring 400' starts to compress under the force of axial movement of second gear portion 600', which axial movement is imparted to second gear portion 600' through the forced engagement between the shallow teeth surfaces 721', 630' of first and second gear portion 700' and 600'.

Upon exceeding the torsional resistance offered by the biasing member 400', the plurality of teeth 720' on the first gear portion 700' disengage from the plurality of teeth 620' on the second gear portion 600' and the manual force applied by the torque applying member rotates the assembly formed by the driving portion 1000' and the first gear portion 700' relative to the receiving portion 110'. Conversely, when the driving portion 1000' is rotated in the loosening direction or the releasing direction, i.e. the direction opposite the tightening direction, the sharp flanks 722' of the first gear portion 700' are forced against the sharp flanks 635' of the second gear portion 600' such that substantially no axial forces are transmitted to second gear portion 600' and no slippage occur between the first gear portion 700' and the second gear portion 600'.

The assembly formed by the biasing member 400' and the adjusting member 300' may be calibrated to inform the operator of the socket 100' of the target torque at which the socket 100' operates. To that effect, markings 335' showing the target torque may be provided on the exterior surface of the cylindrical hollowed housing 305'. Such markings may be visible through a circular window 255' arranged in the body 200' of the socket 100'.

Figure 14:
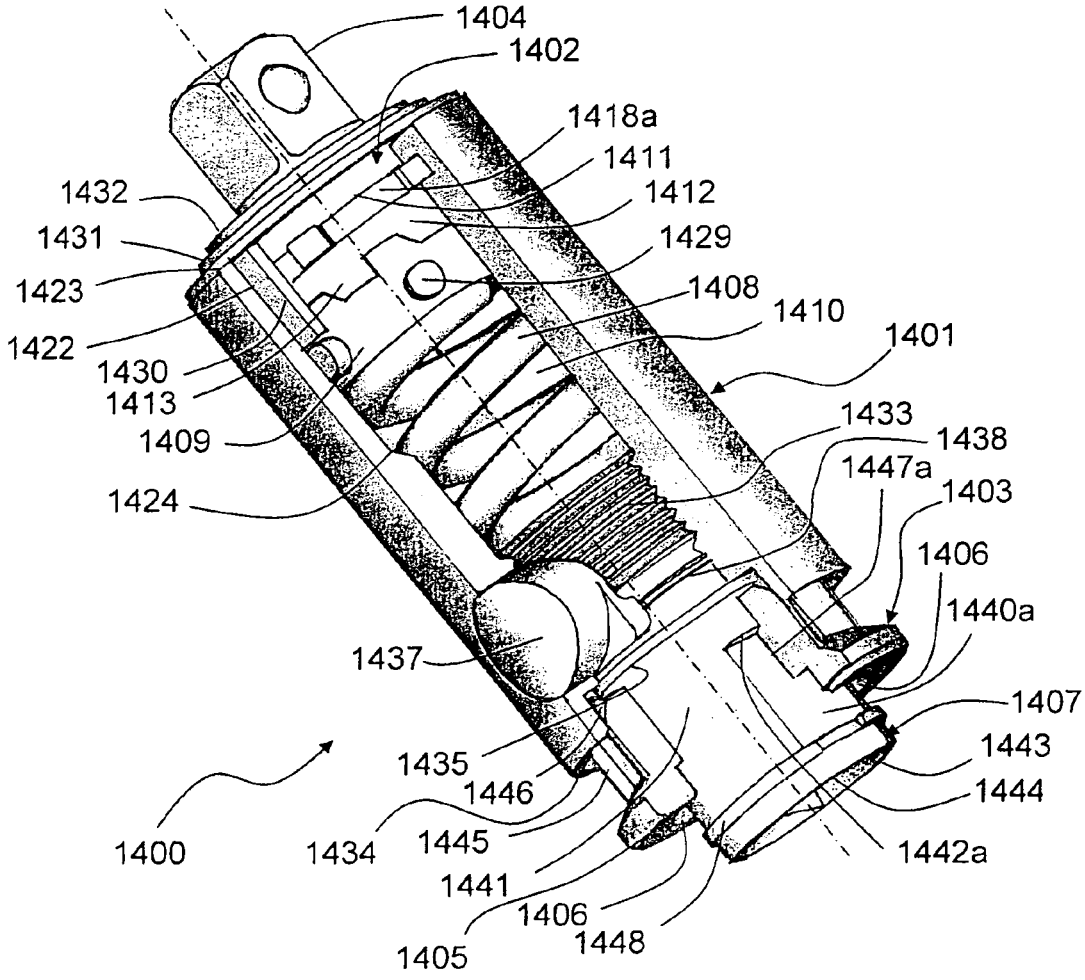
FIG. 14 is a perspective view, partly in section, of a torque adaptor in accordance with an embodiment of the invention.
Figure 15:
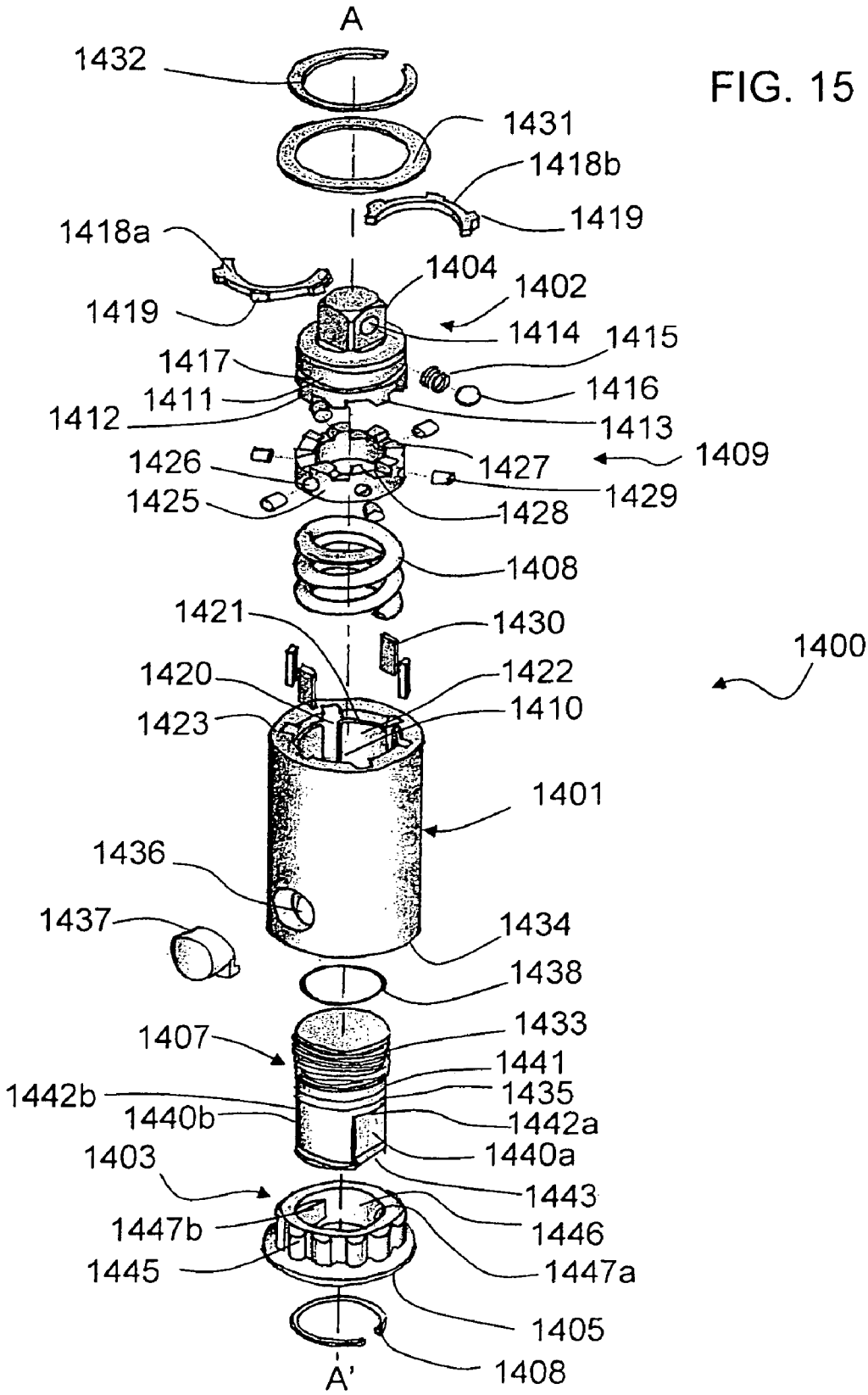
FIG. 15 is an exploded view of the torque adaptor shown in FIG. 14.

FIGS. 14 and 15 show respectively a perspective view, partly in section, and an exploded view of a torque adaptor 1400 in accordance with an embodiment of the invention. The torque adaptor 1400 includes a body 1401, a driving portion 1402 and a receiving portion 1403. The receiving portion 1403 has at one end 1405 an interior surface 1406 that defines a multi-faceted interior shape for engaging a workpiece. The workpiece may be a spark plug, such as the one shown in FIG. 1. Alternatively, the interior surface 1406 may be adapted to receive a wrench male drive that would drive a workpiece (e.g., a spark plug) to the set torque level. A torque applying member, such as a conventional wrench, may be used to receive the male drive head 1404 of the driving portion 1402 such that torque applied to driving portion 1402 is transmitted to the body 1401 and the receiving portion 1403 to effect rotation thereof. The male drive head 1404 of the driving portion 1402 may be a ⅜" head.

The torque adaptor 1400 also includes an adjusting member 1407, a biasing member 1408 and a gear plate or gear portion 1409 that are received in the interior 1410 of the body 1401. As explained in more detail below, the male drive head 1404 is adapted to drive the gear plate 1409.

As can be seen in FIGS. 14 and 15, the driving portion 1402 includes the male drive head 1404, an intermediate portion 1411 and a toothed circular plate 1412 on which a plurality of teeth 1413 is provided. The male drive head 1404 includes a cavity 1414 that is adapted to receive a spring 1415 and a ball 1416. In this configuration, the spring 1415 and the ball 1416 acts as a retaining mechanism that retains the head of the torque applying member (not shown in FIGS. 14-15). In particular, when the male drive head 1404 is received in the head of the torque applying member, the spring 1415 biases the ball 1416 against the interior wall of the head of the torque applying member, thereby securing the male drive head 1404 to the head of the torque applying member (not shown in FIGS. 14-15).

The intermediate portion 1411 of the driving portion 1402 includes a groove 1417 that receives two half polygon plates 1418*a-b*, which, together, substantially surround the periphery of the groove 1417. The half polygon plates 1418*a-b* each include a plurality of external tabs 1419 that are configured to engage both the longitudinal slots 1420 and a circular groove 1421 that are arranged in the inner surface 1422 of the body 1401. In the embodiment of FIGS. 14-15, the longitudinal slots 1420 extend from the upper surface 1423 of the body 1401 to an end 1424 (partly shown in FIG. 14).

The driving portion 1402 is engaged with the gear plate or gear portion 1409. The gear plate 1409 is rotationally secured within the body 1401 via a plurality of roller pins 1429 so that rotation of the gear plate 1409 about the longitudinal axis of the body 1401 rotates the body 1401. The inner surface 1422 of the body 1401 is substantially cylindrical and is configured to receive the external wall portion 1425 of the gear plate 1409. The roller pins 1429 are constructed and arranged such that a portion thereof is retained in the equally spaced holes 1426, which are radially arranged on the external wall portion 1425 of the gear plate 1409, while another portion thereof is retained in the longitudinal slots 1420 provided in the body 1401.

The gear plate 1409 also includes a plurality of teeth 1427 that is arranged on the upper portion 1428 of the gear plate 1409. The plurality of teeth 1413 and 1427 have substantially the same shape as the teeth of the first and second gear portions 700, 600 shown in the embodiments of FIGS. 2-13.

The gear plate 1409 is arranged within the body 1401 by first positioning the gear plate 1409 relative to the body 1401 such that the roller pins 1429 align with the longitudinal slots 1420. Then, the gear plate 1409 is slideably translated within the body 1401 (see FIG. 14).

In order to secure the driving portion 1402 to the body 1401, the driving portion 1402 is first positioned relative to the body 1401 such that the external tabs 1419 of the two half polygon plates 1418*a-b* align with the longitudinal slots 1420. Then, the driving portion 1402 and the body 1401 are moved relative to each other in the longitudinal direction AA' of the body 1401 such that the external tabs 1419 align with the circular groove 1421. At this point, the driving portion 1402 is rotated about the longitudinal axis AA' of the body 1401 until the tabs 1419 no longer align with the longitudinal slots 1420. In this configuration, the driving portion 1402 is in a lock position because the movements of the driving portion 1402 along the longitudinal axis AA' are prevented.

In order to prevent the external tabs 1419 from re-engaging the longitudinal slots 1420, and thus preventing the driving portion 1402 from disengaging the body 1401, a plurality of flat plates 1430 are inserted into the longitudinal slots 1420. As best seen in FIG. 14, the flat plates 1430 abut the upper surface 1423 of the body 1401. A spring plate 1431 rests on the upper surface 1423 of the body 1401 and around the circumference of the intermediate portion 1411 to secure the flat plates 1430 within the longitudinal slots 1420. A locking ring 1432, which rests around the circumference of the intermediate portion 141 1, maintains the spring plate 1431 in contact with the upper surface 1423 of the body 1401, as shown in FIG. 14

The adjusting member 1407 is provided with an exterior surface threaded portion 1433 that is received by threads formed on an interior surface portion of the body 1401 (see FIG. 14). The adjusting member 1407 may be screwed up or down inside the body 1401 in order to set the required level of torque. A displacement of the adjusting member 1407 toward the driving portion 1402 compresses the biasing member 1408, thereby increasing its level of stress. Conversely, a displacement of the torque adjusting member 1407 toward the opposite end 1434 of the body 1401 loosens the biasing member 1408, thereby reducing its level of stress. During such displacements, the gear plate 1409 is guided along the longitudinal slots 1420 via the roller pins 1429. The biased force exerted by the biasing member 1408 on the gear plate 1409 is transmitted to the driving portion 1402, as explained in the embodiments of FIGS. 2-13.

Setting markings 1435 are provided on the circumference of the adjusting member 1407 in order to set the desired torque. The setting markings 1435 indicate the torque at which the driving portion 1402 disengages from the gear plate 1409. In an embodiment, the markings 1435 include torque indications that correspond to 13, 15, 20 and 25 foot pounds of torque. The markings 1435 can be seen through the window 1436 arranged in the body 1401. A transparent view cover 1437 may be arranged within the window 1436 to see the markings 1435. As can be seen in FIG. 14, a ring 1438 may be placed around the adjusting member 1407 at a position that indicates that there is no compression of the biasing member 1408. When the ring 1438 is visible through the transparent view cover 1437, there is no pressure on the biasing member 1408. In that way, the user can determine at all times whether or not the biasing member is under compression.

The adjusting member 1407 includes a cylindrical body 1441 and two generally parallel flat portions 1440*a-b* formed thereon. The flat portions 1440*a-b* extend from intermediate portions 1442*a-b* of the cylindrical body 1441 to the lower end 1443 thereof. A cavity 1444 is formed within the cylindrical body 1441 at the lower end 1443 to engage a male drive head, such as, for example, a ⅜" male drive head. Engaging the cavity 1444 with a male drive head of a wrench enables the adjusting member 1407 to be screwed up or down inside the body 1401 in order to set the desired level of torque.

The receiving portion 1403 is adapted to engage the adjusting member 1407, as shown in FIG. 14. The receiving portion 1403 includes a splined outer surface 1445 that is adapted to engage a corresponding splined inner surface (not show in FIGS. 14-15) provided within the main body 1401. When the receiving portion 1403 is received within the body 1401, rotation of the receiving portion 1403 relative to the body 1401 about the longitudinal axis AA' is prevented.

The receiving portion 1403 also includes an inner surface 1446 that has two substantially parallel flat portions 1447*a-b*. The flat portions 1447*a-b* are adapted to engage the flat portions 1440*a-b* formed on the cylindrical body 1441 and abut the intermediate portions 1442*a-b*. In this configuration, the receiving portion 1403 and the adjusting member 1407 rotate in unison. A lock ring 1448 is placed around the cylindrical body 1441 and proximate the lower end 1443 of the adjusting member 1407 in order to prevent separation of the receiving portion 1403 from the adjusting member 1407.

The receiving portion 1403 is slideably engaged around the cylindrical body 1441 of the adjusting member 1407 and is able to move between a first position and a second position, in which, respectively, the splined outer surface 1445 of the receiving portion 1403 is received within, and disengaged from, the corresponding splined inner surface of the body 1401. In the first position, the receiving portion 1403 is locked to the body 1401 and the adjusting member 1407 cannot rotate. In this first position, the interior surface 1406 of the receiving portion 1403 engages the workpiece to drive the workpiece to the desired torque. In the second position, the splined outer surface 1445 of the receiving portion 1403 no longer contacts the corresponding splined inner surface of the body 1401 and the receiving portion 1403 is unlocked. In this second position, a wrench may be used to rotate the adjusting member 1407 in order to set the desired torque.

Operation of the torque adaptor 1400 is performed substantially the same way as in the embodiment of FIGS. 2-13. As the driving portion 1402 is rotated in the tightening or fastening direction with a torque applying member, such as a wrench, it directly drives gear plate 1409. Since the plurality of teeth 1413 of the driving portion 1402 are engaged with the plurality of teeth 1427 of the gear plate 1409, rotation of the driving portion 1402 drives the gear plate 1409, which in turn drives the body 1401 and the receiving portion 1403 (locked in the first position) until the torque exerted by the torque applying member exceeds the torsional resistance offered by the biasing member 1408 via the engagement between the driving portion 1402 and the gear plate 1409. During rotation of the torque adaptor in the tightening or fastening direction, the flanks of shallow inclination of the driving portion 1402 will begin to slide over the flanks of shallow inclination of the gear plate 1409, as the threshold force set by the adjusting member 1407 is approached.

Specifically, and as explained previously in the embodiments of FIGS. 2-13, the engaged shallow flank surfaces apply an axial force upon the gear plate 1409. When that force increases towards the threshold level set by the axial position of adjusting member 1407, the biasing member 1408 starts to compress under the force of the axial movement of gear plate 1409, which axial movement is imparted to gear plate 1409 through the forced engagement between the shallow teeth surfaces of the driving portion and gear plate 1409.

Upon exceeding the torsional resistance offered by the biasing member 1408, the plurality of teeth 1413 on the driving portion 1402 disengage from the plurality of teeth 1427 on the gear plate 1409 and the manual force applied by the torque applying member rotates the driving portion 1402 relative to the body 1401. Conversely, when the driving portion 1402 is rotated in the loosening direction or the releasing direction, i.e. the direction opposite the tightening direction, the sharp flanks of the teeth 1413 of the driving portion 1402 are forced against the sharp flanks of the teeth of the gear plate 1409 such that substantially no axial forces are transmitted to gear plate 1409 and no slippage occurs between the driving portion 1402 and the gear plate 1409.

Figure 16:
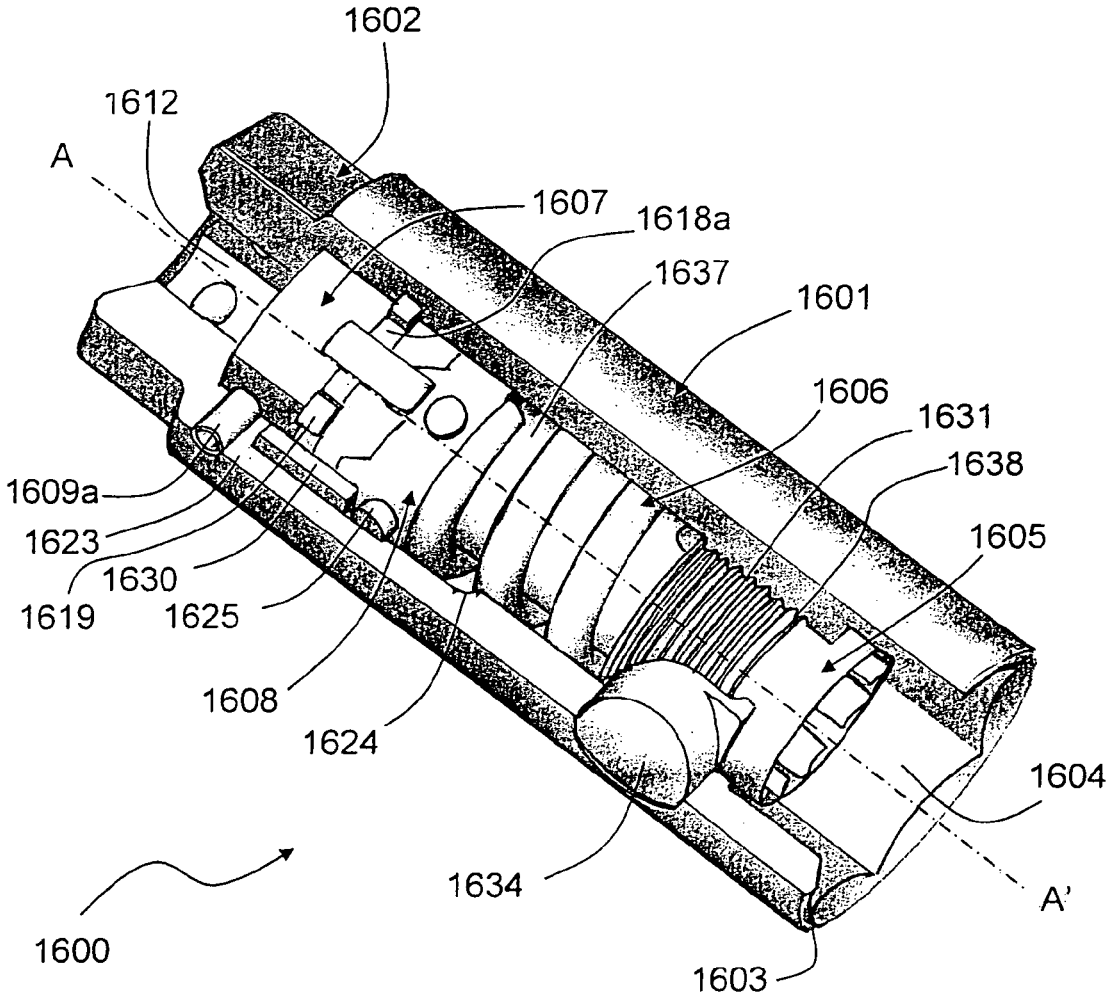
FIG. 16 is a perspective view, partly in section, of a torque adaptor in accordance with an embodiment of the invention.
Figure 17:
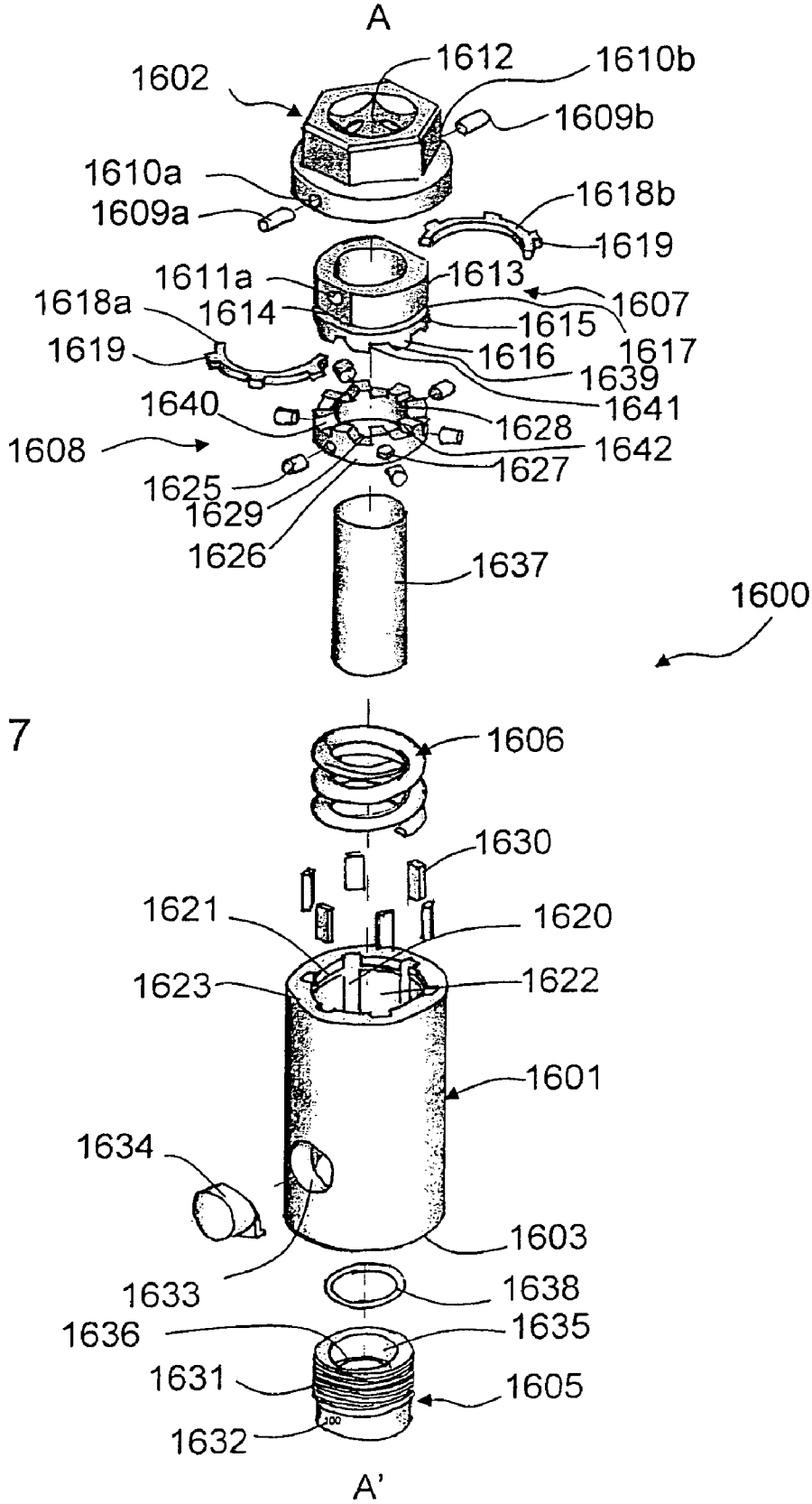
FIG. 17 is an exploded view of the torque adaptor shown in FIG. 16.

FIGS. 16 and 17 show respectively a perspective view, partly in section, and an exploded view of the over torque proof socket 1600 in accordance with another embodiment of the invention. Similarly to the embodiment shown in FIG. 2, the socket 1600 includes a workpiece receiving portion 1601 and a driving portion 1602, which form together the body of the socket 1600. The workpiece receiving portion 1601 has at one end 1603 thereof a peripheral interior surfaces 1604 defining multi-faceted interior shape, for engaging a multi-faceted workpiece. In the embodiment shown, surfaces 1604 define a hexagonal interior shape for engaging the hexagonal casing of a workpiece to be rotationally secured. The workpiece may be a spark plug such as the one shown in FIG. 1.

Similarly to the embodiment of FIG. 2, the socket 1600 also includes an adjusting member 1605, a biasing member 1606, a first gear portion 1607 and a gear plate or second gear portion 1608 that are arranged inside the receiving portion 1601. The driving portion 1602 is constructed and arranged to drive the first gear portion 1607. In the embodiment shown in FIGS. 16-17, the driving portion 1602 is secured to the first gear portion 1607 via two pins 1609*a-b* that are inserted into the lateral holes 1610*a-b* and 1611*a-b* of respectively the driving portion 1602 and the first gear portion 1607 (1611*b* not shown). The driving portion 1602 may be disengaged from the first gear portion 1607 by removing the pins 1609*a-b*.

A torque applying member, such as a conventional wrench, may be used to engage the top square cavity 1612 of the driving portion 1602 such that torque applied to the driving portion 1602 is transmitted to the receiving portion 1601 to effect rotation thereof. In an embodiment, a square drive wrench such as a ratchet wrench may be used to engage the top square cavity 1612. In another embodiment, square drive wrench handles without a ratchet may also be used to engage the top square cavity 1612.

As can be seen in FIG. 16, the first gear portion 1607 has a cylindrical hole formed therethrough and includes an upper portion 1613, an intermediate portion 1614 and a toothed circular plate 1615 on which a plurality of teeth 1616 is provided. The intermediate portion 1614 of the first gear portion 1607 includes a groove 1617 that receives two half polygon plates 1618*a-b*, which, together, substantially surround the periphery of the groove 1617. The half polygon plates 1618*a-b* each include a plurality of external tabs 1619 that are configured to engage both the longitudinal slots 1620 and a circular groove 1621 that are arranged in the inner surface 1622 of the receiving portion 1601. In the embodiment of FIGS. 16-17, the longitudinal slots 1620 extend from the upper surface 1623 of the receiving portion 1601 to an end 1624 (partly shown in FIG. 16).

The first gear portion 1607 is engaged with the gear plate or second gear portion 1608. The gear plate 1608 is rotationally secured within the receiving portion 1601 via a plurality of roller pins 1625 so that rotation of the gear plate 1608 about the longitudinal axis AA' of the receiving portion 1601 rotates the receiving portion 1601. The inner surface 1622 of the receiving portion 1601 is substantially cylindrical and is configured to receive the external wall portion 1626 of the gear plate 1608. The roller pins 1625 are constructed and arranged such that a portion thereof is retained in the equally spaced holes 1627, which are radially arranged on the external wall portion 1626 of the gear plate 1608, while another portion thereof is retained in the longitudinal slots 1620 provided in the receiving portion 1601.

The second gear portion or gear plate 1608 also includes a plurality of teeth 1628 that is arranged on the upper portion 1629 of the gear plate 1408. The plurality of teeth 1616 and 1628 have substantially the same shape as the teeth of the first and second gear portions 700, 600 shown in the embodiments of FIGS. 2-13.

The second gear portion or gear plate 1608 is arranged within the receiving portion 1601 by first positioning the gear plate 1608 relative to the receiving portion 1601 such that the roller pins 1625 align with the longitudinal slots 1620. Then, the gear plate 1608 is slideably translated within the receiving portion 1601 (see FIG. 16).

In order to secure the first gear portion 1607 to the receiving portion 1601, the first gear portion 1607 is first positioned relative to the receiving portion 1601 such that the external tabs 1619 of the two half polygon plates 1618*a-b* align with the longitudinal slots 1620. Then, the first gear portion 1607 and the receiving portion 1601 are moved relative to each other in the longitudinal direction AA' of the receiving portion 1601 such that the external tabs 1619 align with the circular groove 1621. At this point, the first gear portion 1607 is rotated about the longitudinal axis AA' of the receiving portion 1601 until the tabs 1619 no longer align with the longitudinal slots 1620. In this configuration, the first gear portion 1607 is in a lock position because the movements of the first gear portion 1607 along the longitudinal axis AA' are prevented.

In order to prevent the external tabs 1619 from re-engaging the longitudinal slots 1620, and thus preventing the first gear portion 1607 from disengaging the receiving portion 1601, a plurality of flat plates 1630 are inserted into the longitudinal slots 1620. As best seen in FIG. 16, the flat plates 1630 abut the upper portion 1623 of the receiving portion 1601.

The adjusting member 1605 is provided with an exterior surface threaded portion 1631 that is received by threads formed on an interior surface portion of the receiving portion 1601 (see FIG. 16). The adjusting member 1605 may be screwed up or down inside the receiving portion 1601 in order to set the required level of torque. A displacement of the adjusting member 1607 toward the driving portion 1602 compresses the biasing member 1606, thereby increasing its level of stress. Conversely, a displacement of the torque adjusting member 1605 toward the opposite end 1603 of the receiving portion 1601 loosens the biasing member 1606, thereby reducing its level of stress. During such displacements, the gear plate 1608 is guided along the longitudinal slots 1620 via the roller pins 1625. The biased force exerted by the biasing member 1606 on the gear plate 1608 is transmitted to the first gear portion 1607, as explained in the embodiments of FIGS. 2-13.

Setting markings 1632 are provided on the circumference of the adjusting member 1606 in order to set the desired torque. The setting markings 1632 indicate the torque at which the first gear portion 1607 disengages from the gear plate 1608. The markings 1632 can be seen through the window 1633 arranged in the receiving portion 1601. A transparent view cover 1634 may be arranged within the window 1633 to see the markings 1632.

As can be seen in FIG. 17, a ring 1638 may be placed on the adjusting member 1605. When the ring 1638 is visible through the transparent view cover 1634, there is no pressure on the biasing member 1606. In that way, the user can determine at all times whether or not the biasing member 1606 is under compression.

The adjusting member 1605 includes an inner cylindrical portion 1635 having a recess 1636 formed therein. The recess 1636 is adapted to retain a cylindrical shield 1637 that prevents dust from entering the socket 1600.

Operation of the socket 1600 is performed substantially the same way as in the embodiment of FIG. 2. As the driving portion 1602 is rotated in the tightening or fastening direction with a torque applying member, such as a wrench, it directly drives the first gear portion 1607, which is rotationally fixed relative to the driving portion 1602. Since the plurality of teeth 1616 of the first gear portion 1607 are engaged with the plurality of teeth 1628 of the second gear portion or gear plate 1608, rotation of the first gear portion 1607 drives the gear plate 1607, which in turn drives the receiving portion 1601 until the torque exerted by the torque applying member exceeds the torsional resistance offered by the biasing member 1606 via the engagement between the first gear portion 1607 and the second gear portion or gear plate 1608. During rotation of the socket 1600 in the tightening or fastening direction, the flanks of shallow inclination 1639 of the first gear portion 1607 will begin to slide over the flanks of shallow inclination 1640 of the gear plate 1608, as the threshold force set by the adjusting member 1605 is approached.

Specifically, the engaged shallow flank surfaces apply an axial force upon gear plate 1608. When that force increases towards the threshold level set by the axial position of adjusting member 1605, the biasing member 1606 starts to compress under the force of axial movement of gear plate 1608, which axial movement is imparted to gear plate 1608 through the forced engagement between the shallow teeth surfaces 1639, 1640 of first gear portion 1607 and gear plate 1608.

Upon exceeding the torsional resistance offered by the biasing member 1606, the plurality of teeth 1616 on the first gear portion 1607 disengage from the plurality of teeth 1628 on the gear plate 1608 and the manual force applied by the torque applying member rotates the assembly formed by the driving portion 1602 and the first gear portion 1607 relative to the receiving portion 1601. Conversely, when the driving portion 1602 is rotated in the loosening direction or the releasing direction, i.e. the direction opposite the tightening direction, the sharp flanks 1641 of the first gear portion 1607 are forced against the sharp flanks 1642 of the second gear portion or gear plate 1608 such that substantially no axial forces are transmitted to gear plate 1608 and no slippage occur between the first gear portion 1607 and the gear plate 1608.

It will be appreciated that the present invention is not limited to the sockets 100, 100', 1400 and 1600. Other arrangements are contemplated which can accommodate control of the tightening of a spark plug or any other workpiece or device for which it is desirable to control torque during tightening. The foregoing specific embodiments have been provided to illustrate the structural and functional principles of the present invention and are not intended to be limiting. To the contrary, the present invention is intended to encompass all modifications, alterations, and substitutions within the spirit and scope of the appended claims.

What is claimed is:

1. A torque adaptor comprising:

a driving portion adapted to be connected with a torque applying handle and a receiving portion directly engageable with a rotatable workpiece, said driving portion being capable of relative rotation with respect to said receiving portion when a threshold amount of torque is exceeded;

a first gear portion capable of being operatively driven by rotation of said driving portion in a fastening direction and an opposite releasing direction;

a second gear portion slideably arranged with respect to said receiving portion, said second gear portion functionally cooperable to drive said receiving portion for rotating the workpiece, said second gear portion being constructed and arranged to engage with and be driven by said first gear portion, said driving engagement between said first gear portion and said second gear portion being released when a torque required to drive said second gear portion exceeds said threshold amount of torque;

a biasing member that applies a force of engagement between said first gear portion and said second gear portion; and an adjusting member functionally cooperable with said biasing member to adjust a magnitude of the force of engagement between said first gear portion and said second gear portion so as to adjust said threshold amount of torque, said adjusting member being arranged in and retained by an inner surface of said receiving portion, wherein the driving portion is provided at a first end of the adapter and the receiving portion is provided at a second end of the adapter, and wherein the adjusting member is accessed through the second end of the adapter to adjust the threshold amount of torque.

2. The torque adaptor of claim 1, wherein said driving portion is constructed and arranged to be removably engaged with said first gear portion.

3. The torque adaptor of claim 1, wherein the second gear portion includes a plurality of spaced holes defined in an outer periphery of said second gear portion, each of said plurality of spaced holes adapted to receive a first end portion of a roller, said roller including a second end portion that engages a longitudinal slot formed in an interior surface of the receiving portion.

4. The torque adaptor of claim 1, wherein the first gear portion is slideably arranged within said receiving portion.

5. The torque adaptor of claim 1, wherein the first gear portion includes a peripheral intermediate portion that is adapted to receive a ring member having an external tab, said external tab being adapted to engage a longitudinal slot and a circular groove formed in an interior surface of the receiving portion.

6. The torque adaptor of claim 5, wherein the longitudinal slot extends along a longitudinal direction of the receiving portion and the circular groove is substantially perpendicular to said longitudinal direction.

7. The torque adaptor of claim 1, wherein said first gear portion includes a head and a toothed plate, said toothed plate having a plurality of teeth arranged on a periphery thereof.

8. The torque adaptor of claim 7, wherein said second gear portion includes a complementary plurality of teeth on a periphery thereof, said complementary plurality of teeth being configured to engage the plurality of teeth of said first gear portion.

9. The torque adaptor of claim 8, wherein each of said plurality of teeth and said complementary plurality of teeth include a sharp flank and a shallow inclined flank, such that, in the fastening direction, when the torque required to drive said second gear portion exceeds said threshold amount of torque, the plurality of teeth of said first gear portion disengage from the complementary plurality of teeth of said second gear portion.

10. The torque adaptor of claim 9, wherein, in the opposite releasing direction, the plurality of teeth of the first gear portion remains engaged with the complementary plurality of teeth of the second gear portion regardless of the torque exerted.

11. The torque adaptor of claim 1, wherein said adjusting member includes a cylindrical housing having at one end thereof a threaded portion that is configured to be threadably engaged with a complementary threaded portion of said receiving portion.

12. The torque adaptor of claim 11, wherein said adjusting member includes a cavity formed in a bottom surface thereof, the cavity being constructed and arranged to receive a head of a wrench for adjusting said threshold amount of torque.

13. The torque adapter of claim 12, wherein the driving portion is provided at a first end of the adapter and the receiving portion is provided at a second end of the adapter, and wherein the wrench is received by the adjusting member through the second end of the adapter.

14. The torque adaptor of claim 11, wherein markings are provided on an outer wall of the cylindrical housing to indicate the threshold amount of torque.

15. The torque adaptor of claim 14, wherein the receiving portion includes a window to read the threshold amount of torque.

16. The torque adaptor of claim 1, further comprising a body configured to house said second gear portion and said biasing member, wherein said receiving portion is moveable along a longitudinal direction of said body between a first position in which said receiving portion engages said body such that a rotation of said driving portion rotates said receiving portion and said rotatable workpiece and a second position in which said receiving portion is disengaged from said body.

17. The torque adaptor of claim 16, wherein said adjusting member includes a cylindrical housing having at one end thereof a threaded portion that is configured to be threadably engaged with a complementary threaded portion of said body.

18. The torque adaptor of claim 16, further comprising a retaining member arranged on said adjusting member, said retaining member adapted to retain said receiving portion when said receiving portion is disengaged from said body.

19. The torque adaptor of claim 18, wherein said retaining member is a lock ring.

20. The torque adaptor of claim 16, wherein said adjusting member is adapted to cooperate with said receiving portion such that a rotational movement of said adjusting member is prevented when said receiving portion is in said first position.

21. The torque adaptor of claim 20, wherein said adjusting member is rotationally moveable when said receiving portion is in said second position.

22. The torque adaptor of claim 16, wherein said receiving portion includes an external splined surface that is adapted to engage a corresponding splined surface defined in an interior of said body when said receiving portion is in said first position.

23. The torque adaptor of claim 16, wherein said driving portion is slideably arranged within said body, said driving portion including an outer surface in contact with an interior surface of said body.

24. The torque adaptor of claim 1, wherein said biasing member is a compression spring.

25. The torque adaptor of claim 1, wherein said receiving portion is slideably moveable along a portion of said adjusting member.

26. The torque adaptor of claim 1, wherein said receiving portion includes at least one flat inner surface that is adapted to engage at least one corresponding flat surface of said adjusting member so as to allow said receiving portion and said adjusting member to rotate in unison.

27. The torque adapter of claim 26, further comprising a lock ring around said adjusting member, said lock ring adapted to assist in preventing separation of said receiving portion from said adjusting member.

28. The torque adapter of claim 1, wherein the first and second gear portions each include a plurality of external devices about an outer periphery thereof, each of the plurality of external devices adapted to engage a longitudinal slot extending along a longitudinal direction in an interior surface of a body that houses the biasing member.

29. The torque adapter of claim 28, wherein each of the plurality of external devices is adapted to engage a circular groove formed in an interior surface of the body, the circular groove being substantially perpendicular to the longitudinal direction of the body, and wherein the first and second gear portions remain engaged with each other and with at least one of the longitudinal slot and the circular groove while said threshold amount of torque is not exceeded.

30. The torque adapter of claim 29, wherein the first gear portion comprises a groove around its periphery, the groove receiving an external ring member having at least one external tab being adapted to engage the longitudinal slot and the circular groove of the body.

31. The torque adapter of claim 30, wherein the driving portion is rotated about the longitudinal axis such that the at least one external tab of the external ring member no longer aligns with the longitudinal slot so as to prevent disengagement of the driving portion from the body.

32. The torque adapter according to claim 31, further comprising at least one locking plate, the locking plate being inserted into the longitudinal slot such that the at least one external tab of the ring member is prevented from engaging the longitudinal slot.

33. The torque adapter of claim 28, wherein the second gear portion includes a plurality of spaced holes defined in an outer periphery of said second gear portion, each of said plurality of spaced holes adapted to receive a portion of a roller, said roller having a portion engaging the longitudinal slot formed in the interior surface of the body.

34. A torque adaptor comprising:

a driving portion adapted to be connected with a torque applying handle and a receiving portion directly engageable with a rotatable workpiece, said driving portion being capable of relative rotation with respect to said receiving portion when a threshold amount of torque is exceeded;

a first gear portion capable of being operatively driven by rotation of said driving portion in a fastening direction and an opposite releasing direction;

a second gear portion functionally cooperable to drive said receiving portion for rotating the workpiece, said second gear portion being constructed and arranged to engage with and be driven by said first gear portion, said driving engagement between said first gear portion and said second gear portion being released when a torque required to drive said second gear portion exceeds said threshold amount of torque;

a biasing member that applies a force of engagement between said first gear portion and said second gear portion; and an adjusting member functionally cooperable with said biasing member to adjust a magnitude of the force of engagement between said first gear portion and said second gear portion so as to adjust said threshold amount of torque, said adjusting member being retained by an inner surface of the receiving portion, wherein the driving portion is provided at a first end of the adapter and the receiving portion is provided at a second end of the adapter, and wherein the adjusting member is accessed from the second end of the adapter to adjust the threshold amount of torque.

35. The torque adaptor of claim 34, wherein the first gear portion is slideably arranged within said receiving portion.

36. The torque adaptor of claim 34, wherein said first gear portion includes a head and a toothed plate, said toothed plate having a plurality of teeth arranged on a periphery thereof.

37. The torque adaptor of claim 36, wherein said second gear portion includes a complementary plurality of teeth on a periphery thereof, said complementary plurality of teeth being configured to engage the plurality of teeth of said first gear portion.

38. The torque adaptor of claim 34, further comprising a body configured to house said second gear portion and said biasing member, wherein said receiving portion is moveable along a longitudinal direction of said body between a first position in which said receiving portion engages said body such that a rotation of said driving portion rotates said receiving portion and said rotatable workpiece and a second position in which said receiving portion is disengaged from said body.

39. The torque adaptor of claim 38, wherein said adjusting member includes a cylindrical housing having at one end thereof a threaded portion that is configured to be threadably engaged with a complementary threaded portion of said body.

40. The torque adaptor of claim 38, further comprising a retaining member arranged on said adjusting member, said retaining member adapted to retain said receiving portion when said receiving portion is disengaged from said body.

41. The torque adaptor of claim 40, wherein said retaining member is a lock ring.

42. The torque adaptor of claim 38, wherein said adjusting member is adapted to cooperate with said receiving portion such that a rotational movement of said adjusting member is prevented when said receiving portion is in said first position.

43. The torque adaptor of claim 42, wherein said adjusting member is rotationally moveable when said receiving portion is in said second position.

44. The torque adaptor of claim 38, wherein said receiving portion includes an external splined surface that is adapted to engage a corresponding splined surface defined in an interior of said body when said receiving portion is in said first position.

45. The torque adaptor of claim 38, wherein said driving portion is slideably arranged within said body, said driving portion including an outer surface in contact with an interior surface of said body.

46. The torque adaptor of claim 34, wherein said receiving portion is slideably moveable along a portion of said adjusting member.

* * * * *